US009105259B2

(12) United States Patent
Akazawa et al.

(10) Patent No.: US 9,105,259 B2
(45) Date of Patent: Aug. 11, 2015

(54) MUSIC INFORMATION DISPLAY CONTROL METHOD AND MUSIC INFORMATION DISPLAY CONTROL APPARATUS

(71) Applicant: Yamaha Corporation, Hamamatsu-Shi, Shizuoka-Ken (JP)

(72) Inventors: Eiji Akazawa, Hamamatsu (JP); Kenichi Takasaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/966,211

(22) Filed: Aug. 13, 2013

(65) Prior Publication Data

US 2014/0047971 A1 Feb. 20, 2014

(30) Foreign Application Priority Data

Aug. 14, 2012 (JP) ..... 2012-179860
Jun. 6, 2013 (JP) ..... 2013-120277

(51) Int. Cl.
*G10H 1/18* (2006.01)
*G10H 1/00* (2006.01)

(52) U.S. Cl.
CPC ..... *G10H 1/0008* (2013.01); *G10H 1/18* (2013.01); *G10H 2220/015* (2013.01); *G10H 2220/091* (2013.01); *G10H 2220/096* (2013.01); *G10H 2220/106* (2013.01); *G10H 2220/121* (2013.01); *G10H 2220/126* (2013.01); *G10H 2220/241* (2013.01)

(58) Field of Classification Search
USPC ..... 84/600–602, 615, 653, 645
IPC ..... G10H 2220/015,2220/121, 2220/091, G10H 2220/096, 2220/241
See application file for complete search history.

(56) References Cited

U.S. PATENT DOCUMENTS 5,792,971 A * 8/1998 Timis et al. ..... 84/609
6,188,010 B1 * 2/2001 Iwamura ..... 84/609
6,252,152 B1 * 6/2001 Aoki et al. ..... 84/609
6,281,420 B1 * 8/2001 Suzuki et al. ..... 84/477 R (Continued)

FOREIGN PATENT DOCUMENTS

EP 1 469 455 A1 10/2004
JP 2005 316195 A 11/2005

(Continued)

OTHER PUBLICATIONS

Anonymous. (Mar. 22, 2012). "iPad Music App Review and Tutorial: GarageBand Note Editing," iOS Music and You, http://iosmusicandyou.com/2012/03/22/ipad-music-app-review-and-tutorial-garageband-note-editing/, last visited, Nov. 8, 2013, 16 pages.

(Continued)

*Primary Examiner* — David Warren
(74) *Attorney, Agent, or Firm* — Morrison & Foerster LLP

(57) ABSTRACT

A music information display control apparatus includes one or more processors configured to display, on a display device, a musical note sequence image in which a musical note iconic image of each musical note is disposed in a musical score area where a time axis is set. The display controller disposes an operation iconic image which accepts an instruction from a user in a vicinity of the musical note iconic image, and changes a display length or a display position of the musical note iconic image in a direction of the time axis according to an instruction to move the operation iconic image.

22 Claims, 21 Drawing Sheets

(56) References Cited

U.S. PATENT DOCUMENTS

| | | | | |
|---|---|---|---|---|
| 6,307,139 | B1 * | 10/2001 | Iwamura | 84/601 |
| 6,380,471 | B2 * | 4/2002 | Matsumoto | 84/477 R |
| 6,689,946 | B2 * | 2/2004 | Funaki | 84/478 |
| 6,911,591 | B2 * | 6/2005 | Akazawa et al. | 84/616 |
| 6,987,220 | B2 * | 1/2006 | Holcombe | 84/483.2 |
| 7,094,962 | B2 * | 8/2006 | Kayama | 84/609 |
| 7,194,686 | B1 * | 3/2007 | Suzuki et al. | 715/716 |
| 7,365,261 | B2 * | 4/2008 | Hirano | 84/600 |
| 7,383,186 | B2 * | 6/2008 | Kemmochi | 704/260 |
| 7,453,035 | B1 * | 11/2008 | Evans et al. | 84/477 R |
| 7,495,165 | B2 * | 2/2009 | Suzuki et al. | 84/622 |
| 7,534,952 | B2 * | 5/2009 | Yamauchi | 84/622 |
| 7,539,941 | B2 * | 5/2009 | Suzuki et al. | 715/716 |
| 7,608,775 | B1 * | 10/2009 | Evans | 84/611 |
| 7,640,501 | B2 * | 12/2009 | Suzuki et al. | 715/723 |
| 7,663,044 | B2 * | 2/2010 | Katsuta | 84/470 R |
| 7,750,224 | B1 * | 7/2010 | Rav-Niv et al. | 84/483.1 |
| 2001/0023633 | A1 * | 9/2001 | Matsumoto | 84/478 |
| 2001/0037720 | A1 * | 11/2001 | Funaki | 84/478 |
| 2004/0007118 | A1 * | 1/2004 | Holcombe | 84/483.2 |
| 2004/0070621 | A1 * | 4/2004 | Suzuki et al. | 345/764 |
| 2004/0094017 | A1 * | 5/2004 | Suzuki et al. | 84/609 |
| 2004/0098404 | A1 * | 5/2004 | Suzuki et al. | 707/102 |
| 2004/0123724 | A1 * | 7/2004 | Funaki | 84/478 |
| 2004/0177745 | A1 * | 9/2004 | Kayama | 84/609 |
| 2004/0186720 | A1 * | 9/2004 | Kemmochi | 704/258 |
| 2005/0204901 | A1 * | 9/2005 | Hasebe | 84/600 |
| 2005/0241462 | A1 * | 11/2005 | Hirano | 84/600 |
| 2007/0044639 | A1 * | 3/2007 | Farbood et al. | 84/609 |
| 2010/0132536 | A1 * | 6/2010 | O'Dwyer | 84/609 |
| 2010/0212478 | A1 * | 8/2010 | Taub et al. | 84/645 |
| 2010/0288105 | A1 * | 11/2010 | Rose | 84/483.2 |
| 2011/0167988 | A1 * | 7/2011 | Berkovitz | 84/483.2 |
| 2012/0325074 | A1 * | 12/2012 | Smirnov | 84/622 |
| 2013/0112062 | A1 * | 5/2013 | Iriyama | 84/453 |
| 2013/0192445 | A1 * | 8/2013 | Sumi et al. | 84/609 |
| 2014/0006031 | A1 * | 1/2014 | Mizuguchi et al. | 704/260 |
| 2014/0047971 | A1 * | 2/2014 | Akazawa et al. | 84/609 |
| 2014/0258903 | A1 | 9/2014 | Kanbara et al. | |

FOREIGN PATENT DOCUMENTS

| | | | |
|---|---|---|---|
| JP | 2006-098557 | A | 4/2006 |
| JP | 2008-165128 | A | 7/2008 |
| JP | 2012 083563 | A | 4/2012 |
| JP | 2012-103575 | A | 5/2012 |
| JP | 2012-178175 | A | 9/2012 |
| WO | WO-2013/047541 | A1 | 4/2013 |
| WO | WO-2013/099529 | A1 | 7/2013 |

OTHER PUBLICATIONS

Anonymous. (Jul. 3, 2012). "GarageBand for iPad MIDI note editing (Piano Roll)," iOS Musician Blog, <http://ww.youtube.com/watch?v=mnM6c1aNEkk>, one page.

Apple Inc. (Jan. 1, 2007). "Logic Pro 8: User Manuals," Editing MIDI Events in the Piano Roll Editor, pp. 397-518, Retrieved from the Internet: <http://manuals.info.apple.com/en/LogicPro_8_User_Manual.pdf>, retrieved on Feb. 19, 2013, 124 pages.

European Search Report mailed Nov. 21, 2013, for EP Application No. 13180093.0, nine pages.

Japanese Office Action mailed Nov. 11, 2014, for JP Patent Application No. JP 2013-120277, with English translation, eight pages.

* cited by examiner

MUSIC INFORMATION DISPLAY CONTROL METHOD AND MUSIC INFORMATION DISPLAY CONTROL APPARATUS

BACKGROUND

The present disclosure relates to a technology of displaying the time sequence of a plurality of musical notes.

Various technologies of displaying the time sequence of a plurality of musical notes and accepting an edit instruction from the user have conventionally been proposed. For example, JP-B-4508196 discloses a technology of displaying the time sequence of a plurality of musical notes on a piano role screen where a time axis and a pitch axis are set and editing the duration of each musical note by moving the connection point between two consecutive musical notes (the end point of each musical note) in the direction of the time axis by an operation with a pointing device such as a mouse.

However, there are cases where it is difficult for the user to provide an instruction to edit musical notes. For example, in a case where a touch panel is used as the input device to provide an instruction to edit musical notes, when the user who intends to edit the duration of a musical note puts his/her finger close to the musical note, the musical note is hidden behind the finger and cannot be seen by the user, so that it is difficult to instruct a desired movement amount while accurately designating the end point of the desired musical note. In view of these circumstances, an object of the present disclosure is to make it easy for the user to provide an instruction to edit musical notes displayed on a display device.

SUMMARY

To solve the above-mentioned problem, according to the present disclosure, there is provided a music information display control method comprising:

displaying, on a display device, a musical note sequence image in which a musical note iconic image of each musical note is disposed in a musical score area where a time axis is set;

disposing an operation iconic image in a vicinity of the musical note iconic image;

accepting an instruction from a user on the operation iconic image; and changing a display length or a display position of the musical note iconic image in a direction of the time axis according to the instruction to move the operation iconic image.

For example, the operation iconic image is disposed in a vicinity of an end portion of the musical note iconic image in the time axis, and a display position of the end portion of the musical note iconic image is changed according to the instruction to move the operation iconic image in a direction of the time axis.

For example, the music information display control method further comprises: switching between display and non-display of the operation iconic image.

For example, the operation iconic image is disposed in a vicinity of only the musical note iconic image selected by the user, and the operation iconic image is not disposed in a vicinity of the musical note iconic image being not selected by the user.

For example, the display and the non-display of the operation iconic image is switched in accordance with a display magnification of the musical score area.

For example, in the disposing step, when a plurality of musical note iconic images in the musical score area are designated, one operation iconic image for the musical note iconic images is disposed; and in the changing step, the display length, in the direction of the time axis, of at least one of the musical note iconic images is changed in accordance with the instruction to move the one operation iconic image.

For example, for each musical note, basic information designates a pitch and an utterance period of the musical note and attribute information designates a musical expression of the musical note, and the music information display control method further comprises: changing the attribute information of the musical note corresponding to the musical note iconic image according to an instruction from the user on the operation iconic image in the vicinity of the musical note iconic image.

For example, a pitch axis is set in the musical score area, and a display position of the musical note iconic image in a direction of the pitch axis is changed while maintaining the display length or the display position of the musical note iconic image in the direction of the time axis according to the instruction to move the operation iconic image.

For example, a pitch axis is set in the musical score area, and a display position of the musical note iconic image in a direction of the pitch axis is changed according to the instruction to move the operation iconic image in the direction of the pitch axis.

For example, in the disposing step, the operation iconic image is disposed in a predetermined display position with respect to the musical note iconic image, and when an other musical note iconic image is disposed in the predetermined display position, the operation iconic image is disposed in a display position different from the predetermined display position and not overlapping the other musical note iconic image.

For example, the music information display control method further comprises: displaying, on the display device, a song image including a song area where a time axis is set, an edit object section according to an instruction from the user in the song area, and a section operation iconic image that accepts the instruction from the user; changing a display length or a display position of the edit object section in the direction of the time axis according to an instruction to move the section operation iconic image in the direction of the time axis; and displaying, on the display device, the musical note sequence image corresponding to the edit object section according to the instruction from the user.

According to the present disclosure, there is also provided a music information display control apparatus comprising:

one or more processors configured to display, on a display device, a musical note sequence image in which a musical note iconic image of each musical note is disposed in a musical score area where a time axis is set, wherein the one or more processors dispose an operation iconic image which accepts an instruction from a user in a vicinity of the musical note iconic image, and changes a display length or a display position of the musical note iconic image in a direction of the time axis according to the instruction to move the operation iconic image.

For example, the one or more processors dispose the operation iconic image in a vicinity of an end portion of the musical note iconic image in the time axis, and the one or more processors change a display position of the end portion of the musical note iconic image according to the instruction to move the operation iconic image in a direction of the time axis.

For example, the one or more processors switch between display and non-display of the operation iconic image.

For example, the one or more processors dispose the operation iconic image in a vicinity of only the musical note iconic image selected by the user, and does not dispose the operation iconic image in a vicinity of the musical note iconic image being not selected by the user.

For example, the one or more processors switch the display and the non-display of the operation iconic image in accordance with a display magnification of the musical score area.

For example, the music information display control apparatus, when a plurality of musical note iconic images in the musical score area are designated, the one or more processors dispose one operation iconic image for the musical note iconic images, and changes the display length, in the direction of the time axis, of at least one of the musical note iconic images according to the instruction to move the one operation iconic image.

For example, the music information display control apparatus comprises: an information manager configured to manage, for each musical note, basic information designating a pitch and an utterance period of the musical note and attribute information designating a musical expression of the musical note, the information manager changes the attribute information of the musical note corresponding to the musical note iconic image according to an instruction from the user on the operation iconic image in the vicinity of the musical note iconic image.

For example, a pitch axis is set in the musical score area, and the one or more processors change a display position of the musical note iconic image in a direction of the pitch axis while maintaining the display length or the display position of the musical note iconic image in the direction of the time axis according to the instruction to move the operation iconic image.

For example, a pitch axis is set in the musical score area, and the one or more processors change a display position of the musical note iconic image in a direction of the pitch axis according to the instruction to move the operation iconic image in the direction of the pitch axis.

For example, the one or more processors dispose the operation iconic image in a predetermined display position with respect to the musical note iconic image, and when an other musical note iconic image is disposed in the predetermined display position, the one or more processors dispose the operation iconic image in a display position different from the predetermined display position and not overlapping the other musical note iconic image.

For example, the one or more processors display, on the display device, a song image including a song area where a time axis is set, an edit object section according to an instruction from the user in the song area, and a section operation iconic image that accepts the instruction from the user; the one or more processors change a display length or a display position of the edit object section in the direction of the time axis according to an instruction to move the section operation iconic image in the direction of the time axis; and the one or more processors display, on the display device, the musical note sequence image corresponding to the edit object section according to the instruction from the user.

BRIEF DESCRIPTION OF THE DRAWINGS

The above objects and advantages of the present disclosure will become more apparent by describing in detail preferred exemplary embodiments thereof with reference to the accompanying drawings, wherein.

DETAILED DESCRIPTION OF EXEMPLARY EMBODIMENTS

First Embodiment

Figure 1:
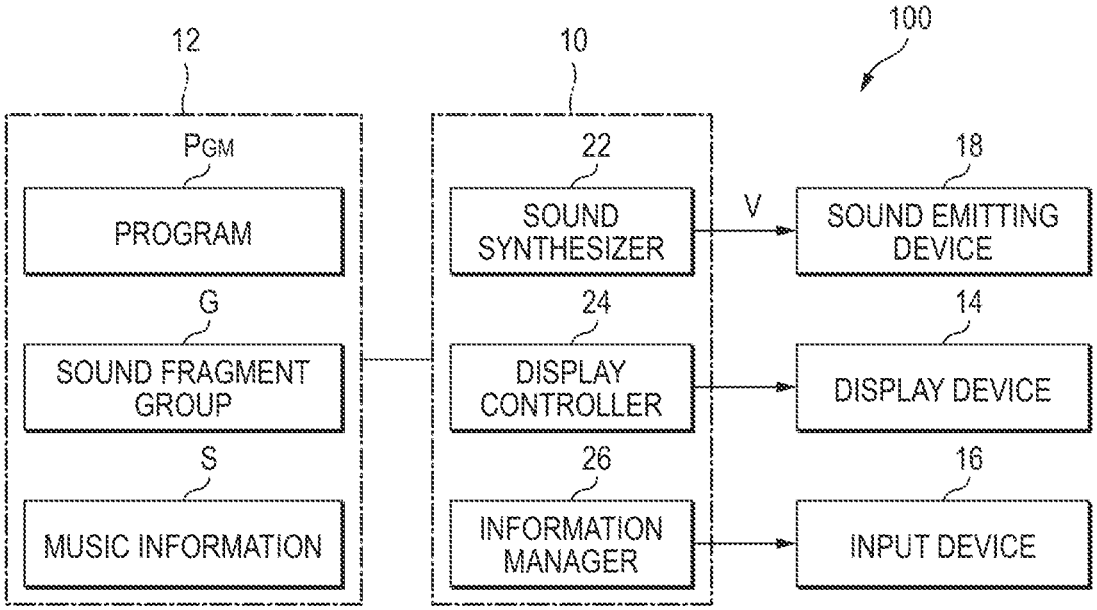
FIG. 1 is a block diagram of a sound synthesizing apparatus according to a first embodiment of the present disclosure.

FIG. 1 is a block diagram of a sound synthesizing apparatus 100 according to a first embodiment of the present disclosure. The sound synthesizing apparatus 100 is a signal processing apparatus that generates a sound signal V of a singing sound (a singing voice) by a fragment connection type sound synthesis, and as shown in FIG. 1, is implemented as a computer system provided with an arithmetic processing unit 10, a storage device 12, a display device 14, an input device 16 and a sound emitting device 18. The sound synthesizing apparatus 100 is implemented, for example, as a stationary information processing apparatus (personal computer) or a portable information processing apparatus (for example, a portable telephone or a smartphone).

The arithmetic processing unit 10 executes a program PGM stored in the storage device 12 to thereby implement a plurality of functions (a sound synthesizer 22, a display controller 24, an information manager 26). The following structures may also be adopted: the functions of the arithmetic processing unit 10 are distributed to a plurality of integrated circuits; and a dedicated electronic circuit (DSP) implements some of the functions. The arithmetic processing unit 10 may be configured by one or more processors.

The display device 14 (for example, a liquid crystal display panel) displays images under the control of the arithmetic processing unit 10. The input device 16 accepts instructions from the user. In the first embodiment, a touch panel formed integrally with the display device 14 and detecting the user's touch of the display screen (touch operation) is assumed as the input device 16. The sound emitting device 18 (for example, a headphone or a speaker) emits a sound wave corresponding to the sound signal V generated by the arithmetic processing unit 10.

The storage device 12 stores the program PGM executed by the arithmetic processing unit 10 and various pieces of data (a sound fragment group G, music information S) used by the arithmetic processing unit 10. A known recording medium such as a semiconductor recording medium or a magnetic recording medium, or a combination of a plurality of recording media is adopted as the storage device 12.

The sound fragment group G is a set of a plurality of sound fragments (sound synthesis library) used as a material of sound synthesis. The sound fragment is a phoneme (for example, a vowel or a consonant) which is the minimum unit of a discrimination in a linguistic sense, or a phoneme chain (for example, a diphone or a triphone) where a plurality of phonemes are coupled together.

Figure 2:
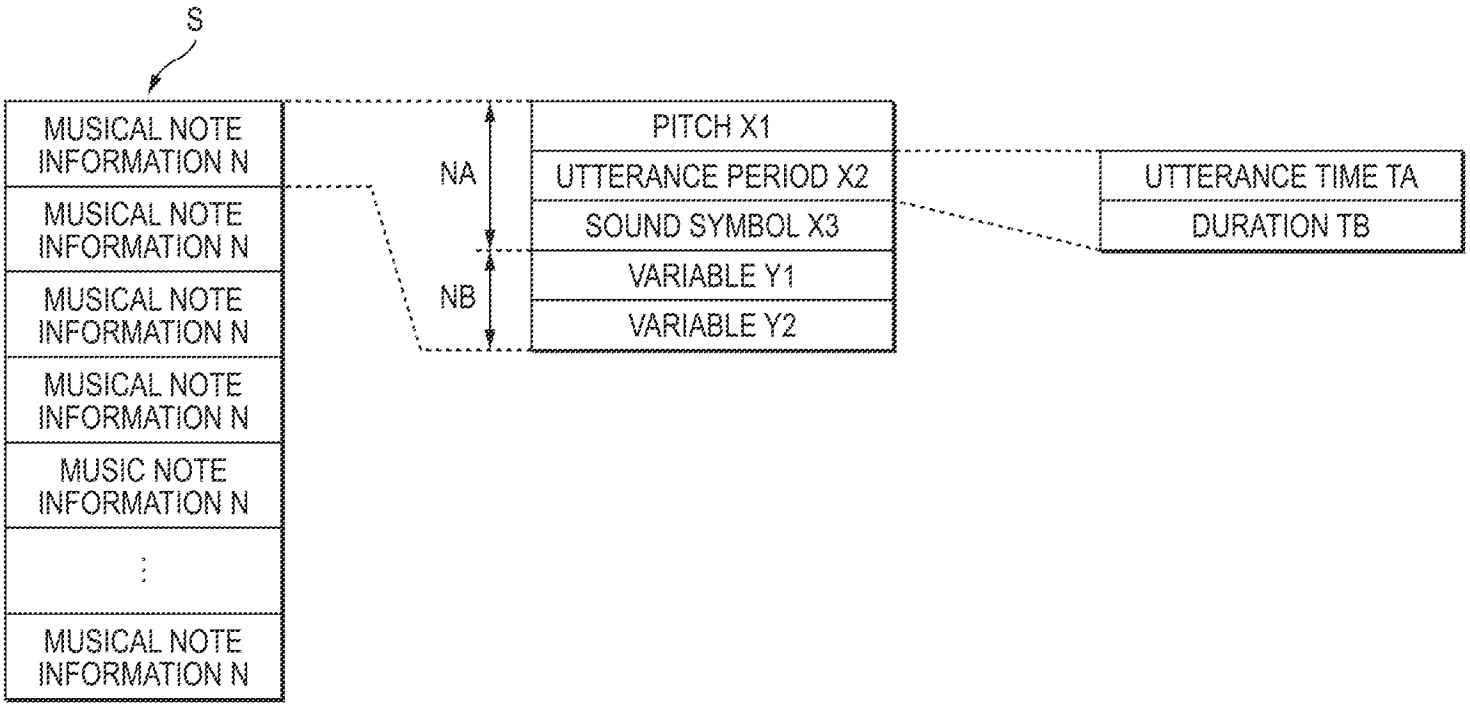
FIG. 2 is a schematic view of music information.

The music information S designates the time sequence of a plurality of musical notes. As shown in FIG. 2, the music information S of the first embodiment is time sequence data (score data) where a plurality of pieces of musical note information N each corresponding to a musical note in a song are arranged. The pieces of musical information N each include basic information NA designating the musical note and attribute information NB designating the musical expression of the musical note.

The basic information NA designates a pitch X1, an utterance period X2 and a sound symbol X3. The pitch X1 is a numerical value representative of the pitch of a musical note (a note number assigned to each pitch). The utterance period X2 indicates the period during which a musical note is uttered, and is defined by a time TA at which the utterance of the musical note is started (hereinafter, referred to as "utterance time") and a time length TB during which the utterance of the musical note is continued (hereinafter, referred to as "duration"). The utterance period X2 may be defined by the utterance time TA and a sound vanishing time (the time at which the utterance of the musical note is ended). The sound symbol X3 is a symbol representative of the content of utterance (grapheme) such as lyrics.

The attribute information NB designates, for each musical note, the numerical values of various variables applied to the control of the musical expression of the singing sound represented by the sound signal V. The attribute information NB of the first embodiment designates the numerical values of a variable Y1 and a variable Y2. The variable Y1 corresponds, for example, to a variable that defines the characteristic of the vibrato (for example, the kind (depth) and period length of the vibrato), and the variable Y2 corresponds, for example, to the volume (dynamics), the velocity (the rising speed of the utterance) and the articulation (brightness).

The sound synthesizer 22 of FIG. 1 generates the sound signal V by using the sound fragment group G and the music information S. Specifically, firstly, the sound synthesizer 22 successively selects, from the sound fragment group G, a sound fragment corresponding to the sound symbol X3 designated by each piece of musical note information N in the music information S, and secondly, adjusts each sound fragment to the pitch X1 and the utterance period X2 (the utterance time TA and the duration TB) designated by each piece of musical note information N. Thirdly, the sound synthesizer 22 interconnects the adjusted sound fragments and adds a musical expression (for example, variations in pitch and volume) according to the attribute information NB of each piece of musical note information N, thereby generating the sound signal V. The sound signal V generated by the sound synthesizer 22 is supplied to the sound emitting device 18 and played back as a sound wave. For the generation of the sound signal V according to the music information S, a known sound synthesis technology is arbitrarily adopted.

Figure 3:
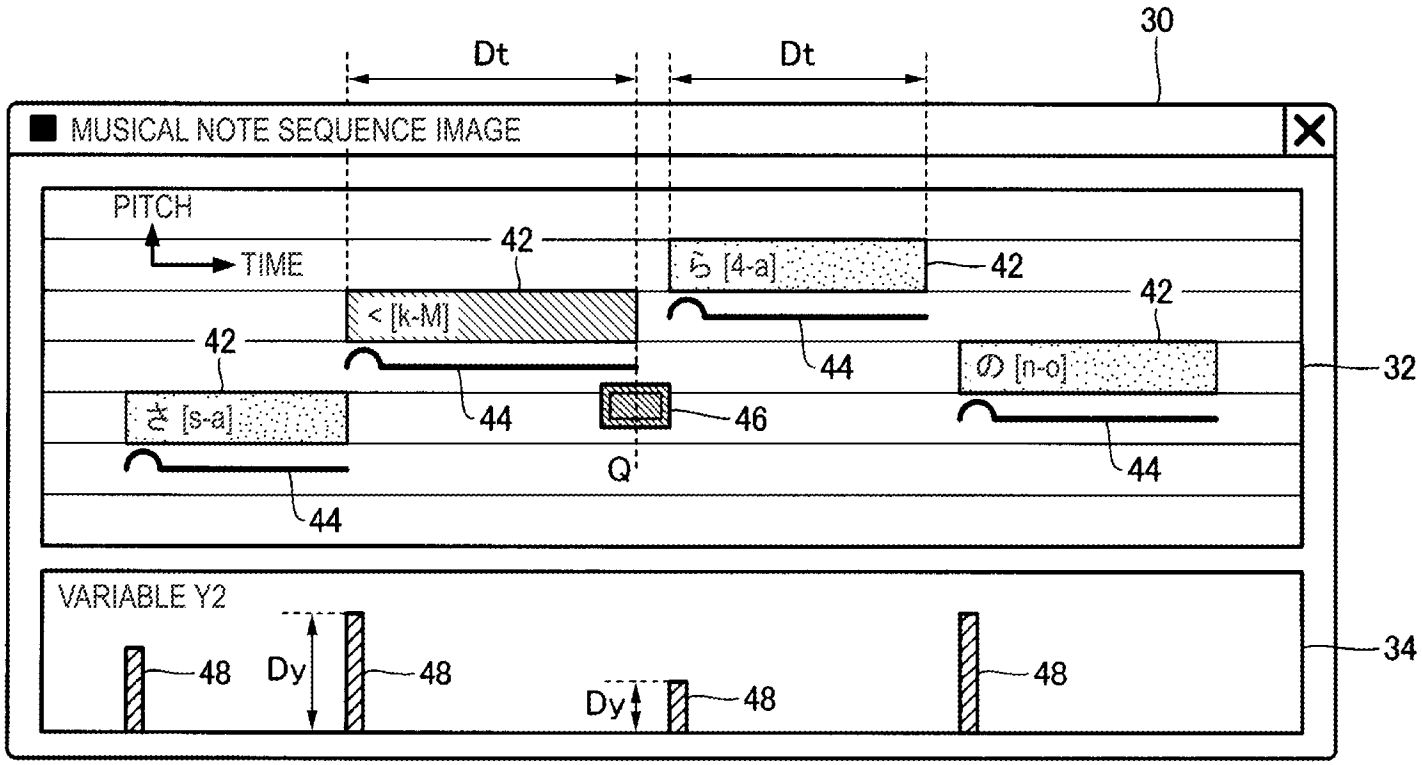
FIG. 3 is a schematic view of a musical note sequence image.

The display controller 24 of FIG. 1 displays, on the display device 14, a musical note sequence image 30 of FIG. 3 visually expressing the content of the music information S. As shown in FIG. 3, the musical note sequence image 30 of the first embodiment includes a musical score area 32 and a variable area 34. The musical score area 32 is a piano role type coordinate plane where a time axis (horizontal axis) and a pitch axis (vertical axis) intersecting each other are set.

In the musical score area 32, musical note iconic images 42 representative of the musical notes designated by the music information S are arranged in chronological order. The musical note iconic images 42 corresponding to the musical notes in the section, according to an instruction from the user, of the song expressed by the music information S are arranged in the musical score area 32. The musical note iconic image 42 of the first embodiment is a rectangular figure. The display position of the musical note iconic image 42 in the direction of the pitch axis is set according to the pitch X1 designated by the basic information NA of the musical note information N, and the display position of the musical note iconic image 42 in the direction of the time axis is set according to the utterance time TA of the utterance period X2 designated by the basic information NA of the musical note information N. The display length Dt of each musical note iconic image 42 in the direction of the time axis is set according to the duration TB (the time length from the utterance time TA to the sound vanishing time) of the utterance period X2 designated by the basic information NA of the musical note information N. That is, the longer the duration TB is, the longer the display length Dt of the musical note iconic image 42 is. The sound symbol X3 (uttered letter) designated by the basic information NA of the musical note information N is added to each musical note iconic image 42.

The information manager 26 of FIG. 1 manages (generates or edits) the music information S according to an instruction from the user on the musical note sequence image 30. For example, when an instruction to add the musical note iconic image 42 to the musical score area 32 is provided by the user, the information manager 26 adds the musical note information N corresponding to the musical note (the pitch X1, the utterance period X2, the sound symbol X3) of the musical note iconic image 42 to the music information S. When an instruction to edit the existing musical note iconic image 42 (for example, to change the pitch X1, the utterance period X2 and the sound symbol X3) is provided by the user, the information manager 26 changes the musical note information N of the musical note iconic image 42 according to the instruction from the user.

In the vicinity of each musical note iconic image 42 in the musical score area 32, an edit image 44 is disposed. The user can provide an instruction to change the variable Y1 (vibrato characteristic) in the attribute information NB by an operation on the edit image 44 of a desired musical note in the musical score area 32. The information manager 26 changes the numerical value of the variable Y1 of the attribute information NB of the musical note corresponding to the edit image 44 according to the instruction from the user on the edit image 44.

In the variable area 34 of FIG. 3, the numerical value of the variable Y2 designated by the attribute information NB of the music information S is displayed. Specifically, in the variable area 34 where the time axis (horizontal axis) common to the musical score area 32 and a numerical value axis (vertical axis) of the variable Y2 designated by the attribute information NB are set, a linear variable iconic image 48, the display length Dy of which in the direction of the numerical value axis is selected according to the numerical value of the variable designated by the attribute information NB is disposed for each musical note in the musical score area 32. The user can provide an instruction to change the variable Y2 of each musical note by an operation on each variable iconic image 48 in the variable area 34. According to the instruction from the user on the variable area 34, the display controller 24 changes the display length Dy of the variable iconic image 48, and the information manager 26 changes the numerical value of the variable Y2 of the attribute information NB. The display form of the variable Y2 in the variable area 34 is changed as appropriate. For example, a curved line and a polygonal line representative of the temporal change of the variable Y2 may be displayed in the variable area 34.

The user can select an arbitrary musical note iconic image 42 in the musical score area 32 by a manipulation on the input device 16 (for example, a manipulation of touching the musical note iconic image 42). For example, FIG. 3 shows as an example a condition where the user selects the musical note iconic image 42 where "<[k–M]" is designated as the sound symbol X3. The display controller 24 displays the musical note iconic image 42 selected by the user in a display form (for example, color or gradation) different from that of the non-selected musical note iconic images 42.

Figure 4:
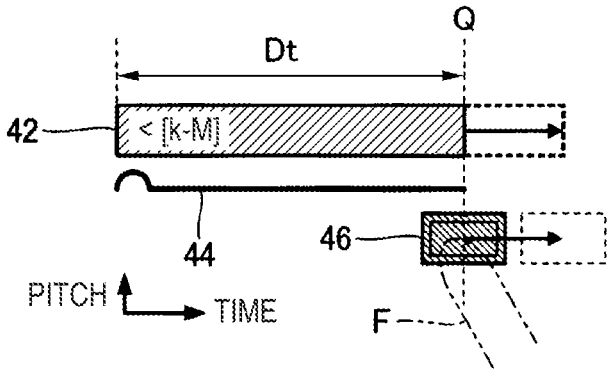
FIG. 4 is an enlargement view of a musical note iconic image of a selected musical note.

The user can switch between selection and non-selection of each musical note iconic image 42 by appropriately manipulating the input device 16 (for example, a manipulation of touching the musical note iconic image 42). When the user selects the musical note iconic image 42 of a desired musical note (hereinafter, referred to as "selected musical note"), as shown in FIG. 3, the display controller 24 disposes an operation iconic image 46 that accepts a manipulation from the user in the vicinity of the musical note iconic image 42 of the selected musical note. FIG. 4 is an enlargement view of the musical note iconic image 42 of the selected musical note. The operation iconic image 46 of the first embodiment is an image (icon) for the user to provide an instruction to change the display length Dt of the musical note iconic image 42 of the selected musical note (the duration TB of the selected musical note). As shown in FIG. 3 and FIG. 4, the operation iconic image 46 of the first embodiment is disposed in the vicinity of the tail end (right end) of the musical note iconic image 42 in the direction of the time axis. Specifically, the positional relationship (distance, etc.) of the operation iconic image 46 with the musical note iconic image 42 is selected so that the user can identify one musical note iconic image 42 corresponding to the operation iconic image 46 from among a plurality of musical note iconic images 42 in the musical score area 32. For example, the operation iconic image 46 is disposed in a position being away from the musical note iconic image 42 on the straight line Q by a predetermined distance in the direction of the pitch axis, the straight line passing the tail end of the musical note iconic image 42 (a position not overlapping the musical note iconic image 42 or the edit image 44). On the other hand, the operation iconic image 46 is not displayed for the non-selected musical note iconic images 42. Consequently, the operation iconic image 46 is not displayed in the musical score area 32 under a condition where the user designates none of the musical note iconic images 42. As described above, the display controller 24 of the first embodiment switches between display and non-display of the operation iconic image 46.

The user can arbitrarily move the operation iconic image 46 in the direction of the time axis by appropriately manipulating the input device 16. Specifically, as shown in FIG. 4, the user can move the operation iconic image 46 by a desired distance toward the downstream side (the direction in which time passes) or toward the upstream side (the direction in which time goes back) in the direction of the time axis by touching the display screen of the display device 14 with a finger F and dragging the operation iconic image 46 in the direction of the time axis (moving it with the finger F touching the display screen). The movement of the operation iconic image 46 in the direction of the pitch axis is inhibited.

The display controller 24 changes the display length Dt, in the direction of the time axis, of the musical note iconic image 42 of the selected musical note according to the movement amount of the operation iconic image 46. Specifically, when the user moves the operation iconic image 46 toward the downstream side in the direction of the time axis (an elapse direction in the time axis), as shown in FIG. 4, the display controller 24 increases the display length Dt by moving the tail end of the musical note iconic image 42 toward the downstream side in the direction of the time axis by a distance corresponding to the movement amount of the operation iconic image 46 while maintaining the position of the starting end (left end) of the musical note iconic image 42. On the other hand, when the user moves the operation iconic image 46 toward the upstream side in the direction of the time axis (a retrospective direction in the time axis), the display controller 24 decreases the display length Dt by moving the tail end of the musical note iconic image 42 toward the upstream side in the direction of the time axis by a distance corresponding to the movement amount of the operation iconic image 46 while maintaining the position of the starting end of the musical note iconic image 42. In the first embodiment, the movement of the operation iconic image 46 in the direction of the pitch axis is not reflected in the musical note iconic image 42. The movement of the operation iconic image 46 in the direction of the pitch axis may be inhibited.

The information manager 26 of FIG. 1 updates the musical note information N of the selected musical note according to the change of the display length Dt of the musical note iconic image 42 by the movement of the operation iconic image 46. Specifically, the information manager 26 updates, of the music information S, the duration TB designated by the musical note information N of the selected musical note to a time length corresponding to the changed display length Dt.

Figure 5:
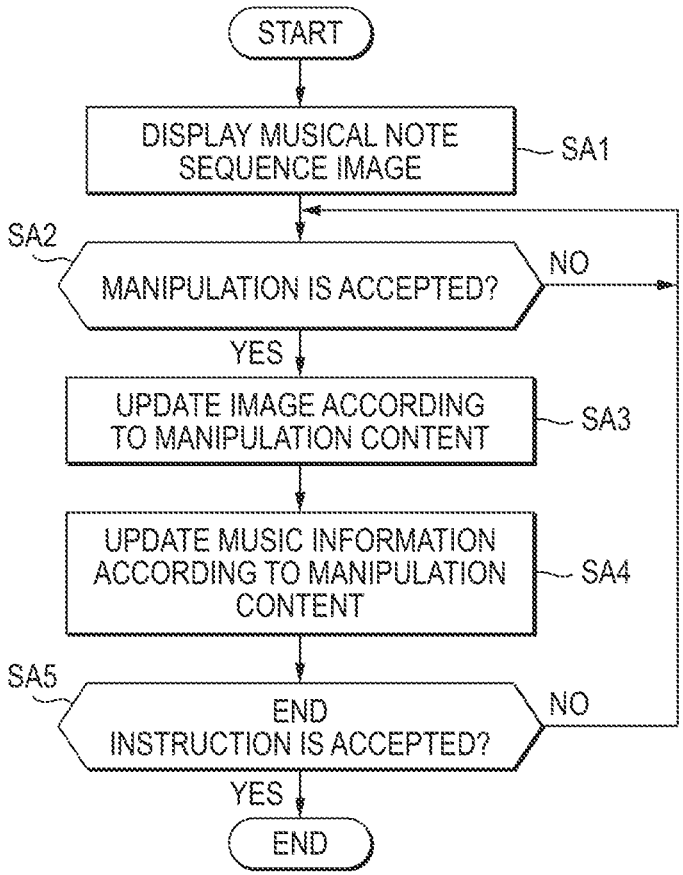
FIG. 5 is a flowchart showing the operation of the sound synthesizing apparatus according to the first embodiment.

FIG. 5 is a flowchart of the operation of the sound synthesizing apparatus 100 (the arithmetic processing unit 10). For example, when an instruction to display the musical note sequence image 30 is provided by the user, the processing of FIG. 5 is started. The arithmetic processing unit 10 displays the musical note sequence image 30 on the display device 14 (SA1). Then, the arithmetic processing unit 10 waits for an operation from the user on the input device 16 (SA2), and when a manipulation from the user is accepted, the arithmetic processing unit 10 changes the content of the musical note sequence image 30 according to the content of a manipulation (SA3). Moreover, the arithmetic processing unit 10 (the information manager 26) changes the music information S according to an instruction from the user (SA4). Specifically, when an instruction to edit the musical note iconic image 42 (for example, to change the display length Dt) is provided by the user, the arithmetic processing unit 10 changes the musical note information N of the musical note iconic image 42 according to the instruction from the user. The arithmetic processing unit 10 repeats the above processing until an instruction to end the operation on the musical note sequence image 30 is provided by the user (SA5: No), and when the end instruction is accepted (SA5: YES), the arithmetic processing unit 10 ends the processing of FIG. 5.

Figure 6:
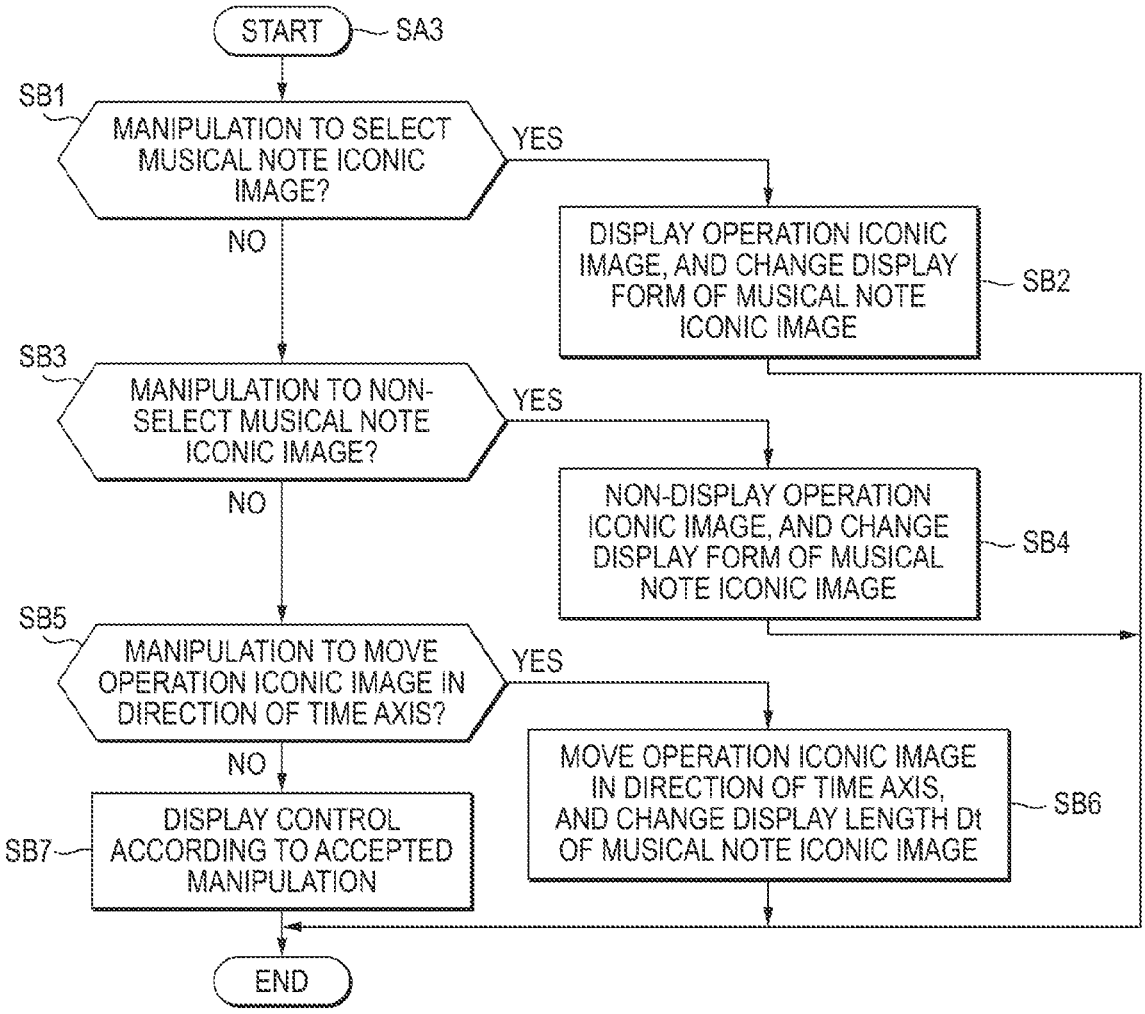
FIG. 6 is a concrete example of the processing of updating the musical note sequence image according to the first embodiment.

FIG. 6 is a flowchart of a concrete example of the processing (step SA3 of FIG. 5) in which the arithmetic processing unit 10 (the display controller 24) changes the content of the musical note sequence image 30 according to a manipulation from the user on the input device 16. The arithmetic processing unit 10 determines whether a manipulation accepted at step SA2 of FIG. 5 is a manipulation to select the musical note iconic image 42 in the musical score area 32 or not (SB1). When selection of the musical note iconic image 42 is accepted (SB1: YES), the arithmetic processing unit 10 displays the musical note iconic image 42 selected by the user in a display form (for example, color or gradation) different from that of the non-selected musical note iconic image 42, and disposes the operation iconic image 46 in the vicinity of the selected musical note iconic image 42 (SB2). On the other hand, when selection of the musical note iconic image 42 is not accepted (SB1: NO), the arithmetic processing unit 10 determines whether or not a manipulation accepted from the user is a manipulation to provide an instruction to non-select (cancel the selection of) the musical note iconic image 42 in the musical score area 32 (SB3). When an instruction to non-select the musical note iconic image 42 is accepted (SB3: YES), the arithmetic processing unit 10 changes the display form of the musical note iconic image 42 selected by the user to that of non-selection, and erases the operation iconic image 46 situated in the vicinity of the non-selected musical note iconic image 42 (SB4). On the other hand, when an instruction to non-select the musical note iconic image 42 is not accepted (SB3: NO), the arithmetic processing unit 10 determines whether a manipulation accepted from the user is a manipulation to move the operation iconic image 46 in the direction of the time axis or not (SB5). When a manipulation to move the operation iconic image 46 in the direction of the time axis is accepted (SB5: YES), the arithmetic processing unit 10 moves the operation iconic image 46 in the direction of the time axis, and changes the display length Dt of the musical note iconic image 42 in the direction of the time axis (SB6). Moreover, the arithmetic processing unit 10 changes the content of the musical note sequence image 30 according to a manipulation other than a manipulation shown above as an example (SB7), and then, ends the processing of FIG. 6 (step SA3 of FIG. 5).

As described above, according to the first embodiment, since the display length Dt of the musical note iconic image 42 of the selected musical note (the duration TB of the selected musical note) is changed by an operation on the operation iconic image 46 disposed separately from the musical note iconic image 42, there is an advantage that the edit of the musical notes is easy compared with the structure in which the display length Dt is changed by a direct operation on the musical note iconic image 42. Specifically, as is understood from FIG. 4, even when the user touches the display screen with the finger F in order to move the operation iconic image 46, the musical note iconic image 42 is not hidden behind the finger F. Therefore, by moving the operation iconic image 46 while continuously checking the musical note iconic image 42 and related information (the sound symbol X3 and the edit image 44), the display length Dt of the musical note iconic image 42 can be easily and accurately change to the one desired by the user.

Moreover, according to the first embodiment, since switching between display and non-display of the operation iconic image 46 is made, there is an advantage that the musical note sequence image 30 is inhibited from becoming complicated (the musical note iconic images 42 can be easily checked), for example, compared with the structure in which the operation iconic image 46 corresponding to each musical note iconic image 42 is fixedly displayed. Particularly according to the first embodiment, since the operation iconic image 46 is displayed in the vicinity of, of a plurality of musical note iconic images 42 in the musical score area 32, the musical note iconic image 42 selected by the user, the effect that the musical note sequence image 30 is inhibited from becoming complicated is significantly remarkable. However, the structure may be adopted in which the operation iconic image 46 corresponding to each musical note iconic image 42 is fixedly displayed in the musical score area 32.

Further, according to the first embodiment, since the tail end of the musical note iconic image 42 moves in conjunction with the movement of the operation iconic image 46 disposed in the vicinity of the tail end of the musical note iconic image 42, an advantage is also produced that the user can intuitively grasp the relationship between the operation on the operation iconic image 46 and the change of the musical note iconic image 42.

Second Embodiment

A second embodiment of the present disclosure will be described below. In the embodiments shown below as examples, for elements the workings and functions of which are similar to those of the first embodiment, the reference numerals referred to in the description of the first embodiment are used and detailed descriptions thereof are omitted as appropriate.

In the second embodiment, the user can change the display magnification R of the musical score area 32 by appropriately manipulating the input device 16. The display controller 24 disposes, in the musical score area 32, the musical note iconic images 42 and the edit images 44 of the display size corresponding to the display magnification R selected by the user, in accordance with the increase of the display magnification R, the musical note iconic images 42 and the edit images 44 in the musical score area 32 become large and the number of them displayed in the musical score area 32 is decreased. On the other hand, in accordance with the decrease of the display magnification R, the musical note iconic images 42 and the edit images 44 become small and the number of them displayed in the musical score area 32 is increased.

The display controller 24 of the second embodiment switches between display and non-display of the operation iconic image 46 according to the display magnification R of the musical score area 32. Specifically, when the display magnification R is higher than a predetermined threshold value RTH (zoom-in), as in the first embodiment, the display controller 24 disposes the operation iconic image 46 in the vicinity of the musical note iconic image 42 of the musical note selected by the user. On the other hand, when the display magnification R is lower than the predetermined threshold value RTH (zoom-out), the display controller 24 does not dispose the operation iconic image 46 in the musical score area 32 even when the user designate a musical note in the musical score area 32 as the selected musical note.

In the second embodiment, similar effects to those of the first embodiment are also realized. Under a condition where the display magnification R is low, since a multiplicity of musical note iconic images 42 and edit images 44 are disposed in the musical score area 32, the complexity of the display content is conspicuous when the operation iconic image 46 is added. According to the second embodiment, since the operation iconic image 46 is not displayed when the display magnification R is lower than the threshold value RTH, there is an advantage that the display content can be inhibited from becoming complicated.

Figure 7:
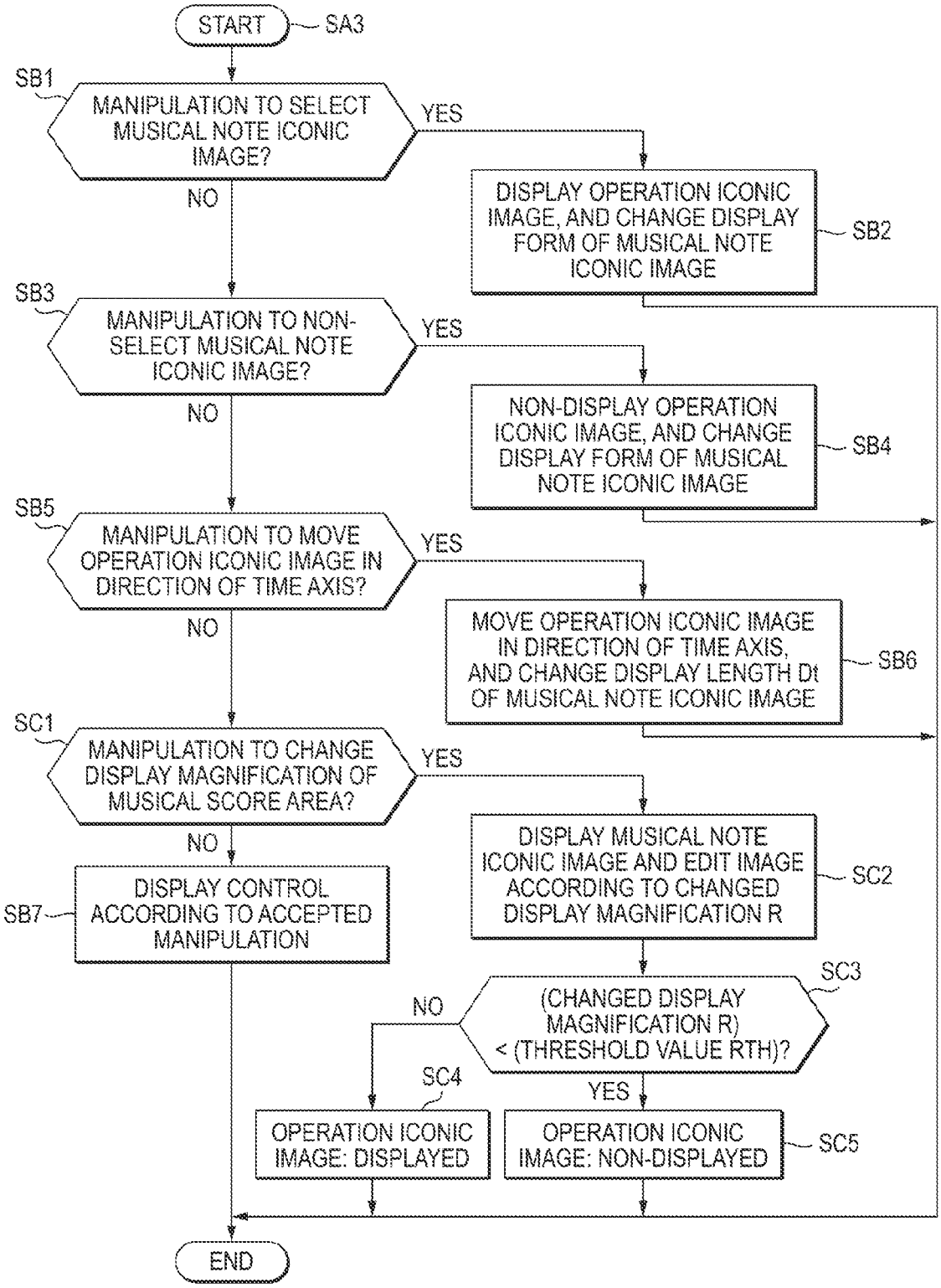
FIG. 7 is a concrete example of the processing of updating the musical note sequence image according to a second embodiment.

FIG. 7 is a flowchart of the operation of the arithmetic processing unit 10 in the second embodiment. The processing of FIG. 7 is executed instead of the processing of FIG. 6 shown as an example in the first embodiment. In the processing of FIG. 7, step SC1 to step SC5 are added to the processing of FIG. 6. When the result of the determination of step SB5 is negative, the arithmetic processing unit 10 determines whether the operation accepted at step SA2 of FIG. 5 is an operation to change the display magnification R of the musical score area 32 or not (SC1). When change of the display magnification R is accepted (SC1: YES), the arithmetic processing unit 10 changes the display size of the musical note iconic image 42 and the edit image 44 according to the display magnification R having changed by the user (SC2). Moreover, the arithmetic processing unit 10 determines whether the changed display magnification R is lower than the predetermined threshold value RTH or not (SC3). When the display magnification R is equal to or higher than the threshold value RTH (SC3: NO), the arithmetic processing unit 10 displays the operation iconic image 46 (SC4), whereas when the display magnification R is lower than the threshold value RTH (SC3: YES), the arithmetic processing unit 10 makes the operation iconic image 46 non-displayed (SC5). On the other hand, when change of the display magnification R is not accepted (SC1: NO), the arithmetic processing unit 10 shifts the process to step SB7. The rest of the processing executed by the arithmetic processing unit 10 is similar to that of the first embodiment (FIG. 6).

Third Embodiment

Figure 8:
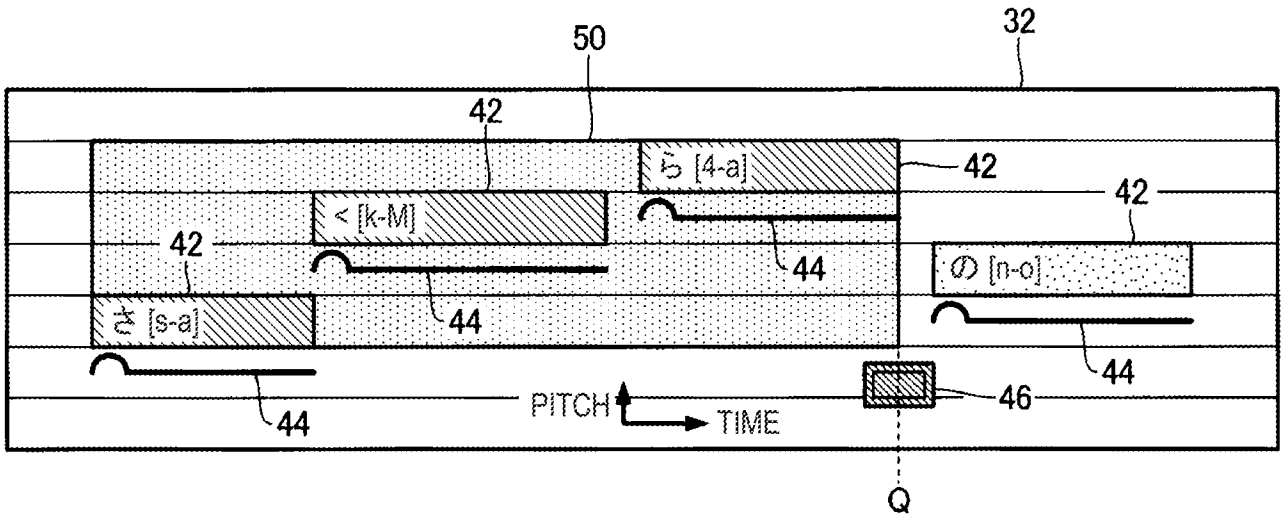
FIG. 8 is a schematic view of a musical score area of a third embodiment.

In the first embodiment, a case where the user designates one musical note iconic image 42 in the musical score area 32 is shown as an example. In the third embodiment, the user can designates a plurality of musical note iconic images 42 in the musical score area 32. FIG. 8 is a schematic view of the musical score area 32 of the third embodiment. As shown in FIG. 8, by designating an arbitrary area (hereinafter referred to as "selected area") 50 in the musical score area 32 by appropriately manipulating the input device 16, the user can designates musical notes corresponding to a plurality of musical note iconic images 42 in the selected area 50, respectively, as selected musical notes.

When the user designates the area 50 in the musical score area 32, the display controller 24 disposes one operation iconic image 46 in the vicinity of the selected area 50 of the musical score area 32. That is, one operation iconic image 46 is displayed for a plurality of selected musical notes. Specifically, the operation iconic image 48 is disposed in a position being away from the selected area 50 on the straight line Q by a predetermined distance in the direction of the pitch axis which line passes the tail end of the musical note iconic image 42 situated temporally at the end among a plurality of musical note iconic images 42 in the selected area 50.

As in the first embodiment, the user can move the operation iconic image 46 in the direction of the time axis by a manipulation on the input device 16 (for example, drag on the display screen). The display controller 24 changes the display lengths Dt, in the direction of the time axis, of a plurality of musical note iconic images 42 in the selected area 50 according to the movement amount of the operation iconic image 46. Specifically, the display lengths Dt of the musical note iconic images 42 in the selected area 50 are increased or decreased at a magnification corresponding to the movement amount of the operation iconic image 46. The information manager 26 updates, of the music information S, the duration TB in the musical note information N corresponding to each musical note iconic image 42 in the selected area 50, to a time length corresponding to the changed display length Dt of each musical note iconic image 42.

Figure 9:
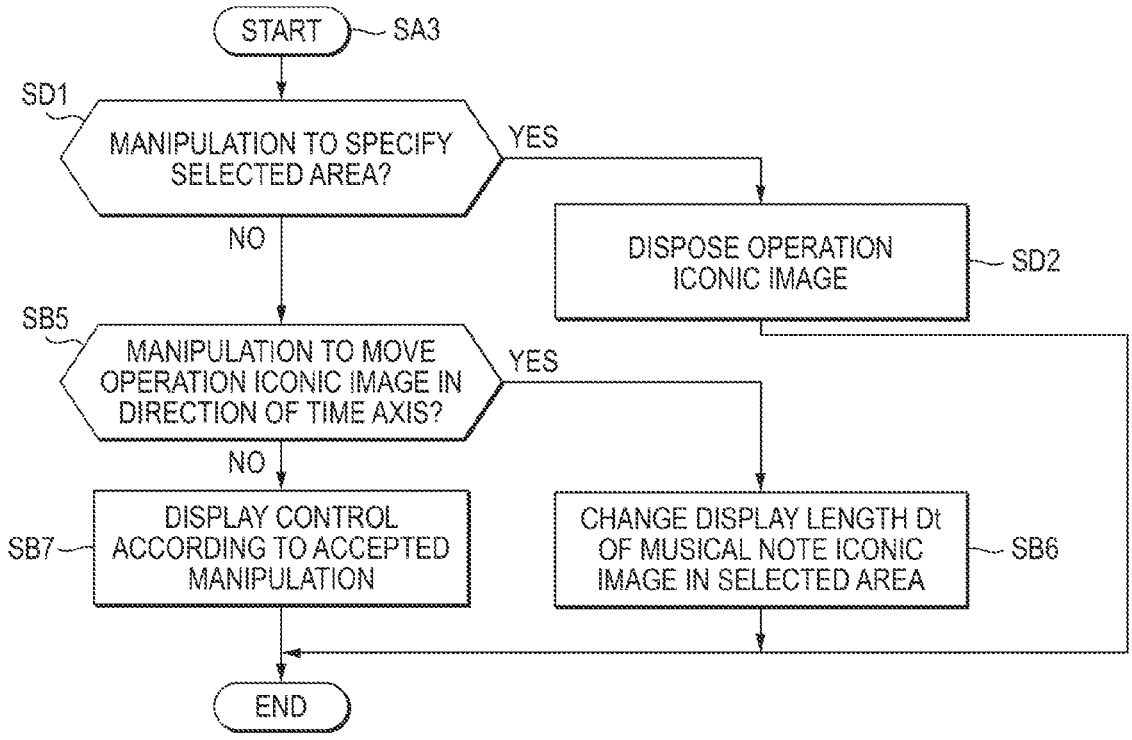
FIG. 9 is a concrete example of the processing of updating the musical note sequence image according to the third embodiment.

FIG. 9 is a flowchart of the operation of the arithmetic processing unit 10 in the third embodiment. The processing of FIG. 9 is executed instead of the processing of FIG. 6 shown as an example in the first embodiment. In the processing of FIG. 9, step SB1 to step SB4 of FIG. 6 are replaced with step SD1 and step SD2 of FIG. 9. First, the arithmetic processing unit 10 determines whether the operation accepted at step SA2 of FIG. 5 is a manipulation to designate the selected area 50 or not (SD1). When designation of the selected area 50 is accepted (SD1: YES), the arithmetic processing unit 10 disposes one operation iconic image 46 in the vicinity of the selected area 50 of the musical score area 32 (SD2). Then, when a manipulation to move the operation iconic image 46 in the direction of the time axis is accepted (SB5: YES), the arithmetic processing unit 10 changes the display length Dt of each of a plurality of musical note iconic images 42 in the selected area 50 in the direction of the time axis according to the movement amount of the operation iconic image 46 (SB6). The rest of the processing executed by the arithmetic processing unit 10 is similar to that of the first embodiment (FIG. 6).

In the third embodiment, similar effects to those of the first embodiment are also realized. Moreover, according to the third embodiment, since the display length Dt of each musical note iconic image 42 in the selected area 50 is changed in conjunction with the movement of one operation iconic image 46, there is an advantage that the load on the user when a plurality of musical note iconic images 42 are edited at a time is reduced.

The display lengths Dt of all the musical note iconic images 42 in the selected area 50 are changed according to the movement of the operation iconic image 46 in the above exemplification. However, for example, in accordance with the movement of the operation iconic image 46, at least the musical note iconic image 42 having the display length Dt which is the largest in the display length among a plurality of musical note iconic images 42 in the selected area 50 may be changed. That is, the display controller 24 of the third embodiment is comprehended as an element that changes the display length Dt of at least one of a plurality of musical note iconic image 42 in the selected area 50 according to the movement of the operation iconic image 46.

Fourth Embodiment

In the first embodiment, the display length Dt of the musical note iconic image 42 of the selected musical note (the duration TB of the selected musical note) is changed in accordance with the movement of the operation iconic image 46 in the direction of the time axis. In the fourth embodiment, in addition to the display length Dt of the musical note iconic image 42, the attribute information NB of the musical note information N of the selected musical note is changed according to an instruction from the user on the operation iconic image 46.

Figure 10:
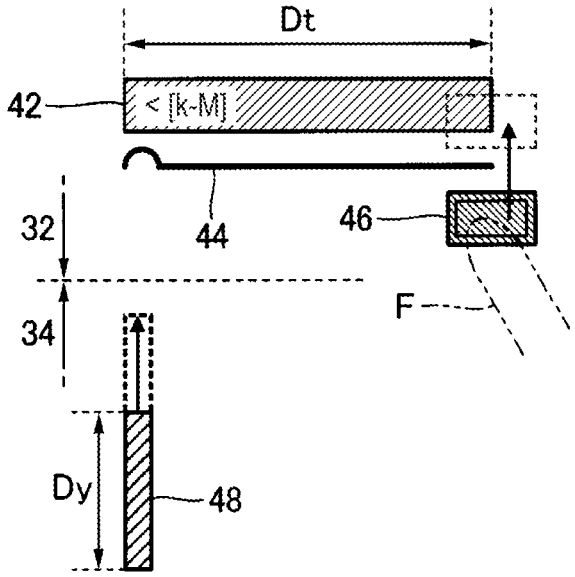
FIG. 10 is an explanatory view of the operation of a fourth embodiment.

FIG. 10 is an explanatory view of the operation of the fourth embodiment. The musical note iconic image 42 of the selected musical note in the musical score area 32 and the variable iconic image 48 in the variable area 34 representative of the numerical value of the variable Y2 of the selected musical note are shown as an example in FIG. 10. In the first embodiment, when the user moves the operation iconic image 46 disposed in the vicinity of the musical note iconic image 42 of the selected musical note in the direction of the time axis, the display length Dt of the musical note iconic image 42 in the direction of the time axis (the duration TB of the selected musical note) is changed according to the movement amount of the operation iconic image 46.

In the fourth embodiment, the user can move the operation iconic image 46 not only in the direction of the time axis but also in the direction of the pitch axis by appropriately manipulating the input device 16 (for example, dragging the operation iconic image 46). The display controller 24 changes the display length Dy of the variable iconic image 48 corresponding to the selected musical note in the variable area 34 according to the movement amount of the operation iconic image 46 in the direction of the pitch axis. Specifically, when the user moves the operation iconic image 46 upward (toward the high pitch side in the direction of the pitch axis), as shown in FIG. 10, the display controller 24 increases the display length Dy of the variable iconic image 48 corresponding to the selected musical note by a change amount corresponding to the movement amount of the operation iconic image 46. On the other hand, when the user moves the operation iconic image 46 downward (toward the low pitch side in the direction of the pitch axis), the display controller 24 decreases the display length Dy of the variable iconic image 48 corresponding to the selected musical note by a change amount corresponding to the movement amount of the operation iconic image 46. Moreover, the information manager 26 updates the variable Y2 of the attribute information NB corresponding to the selected musical note to a numerical value corresponding to the changed display length Dy. In a structure in which the attribute information NB includes a plurality of kinds of variables Y2, the numerical value of one or more kinds of variables Y2 selected by the user from among a plurality of kinds of variables Y2 can be updated according to a manipulation on the display length Dy. Moreover, a structure may be adopted in which the function of updating the variable Y2 according to the display length Dy is canceled by the user's non-selection of each variable Y2.

Figure 11:
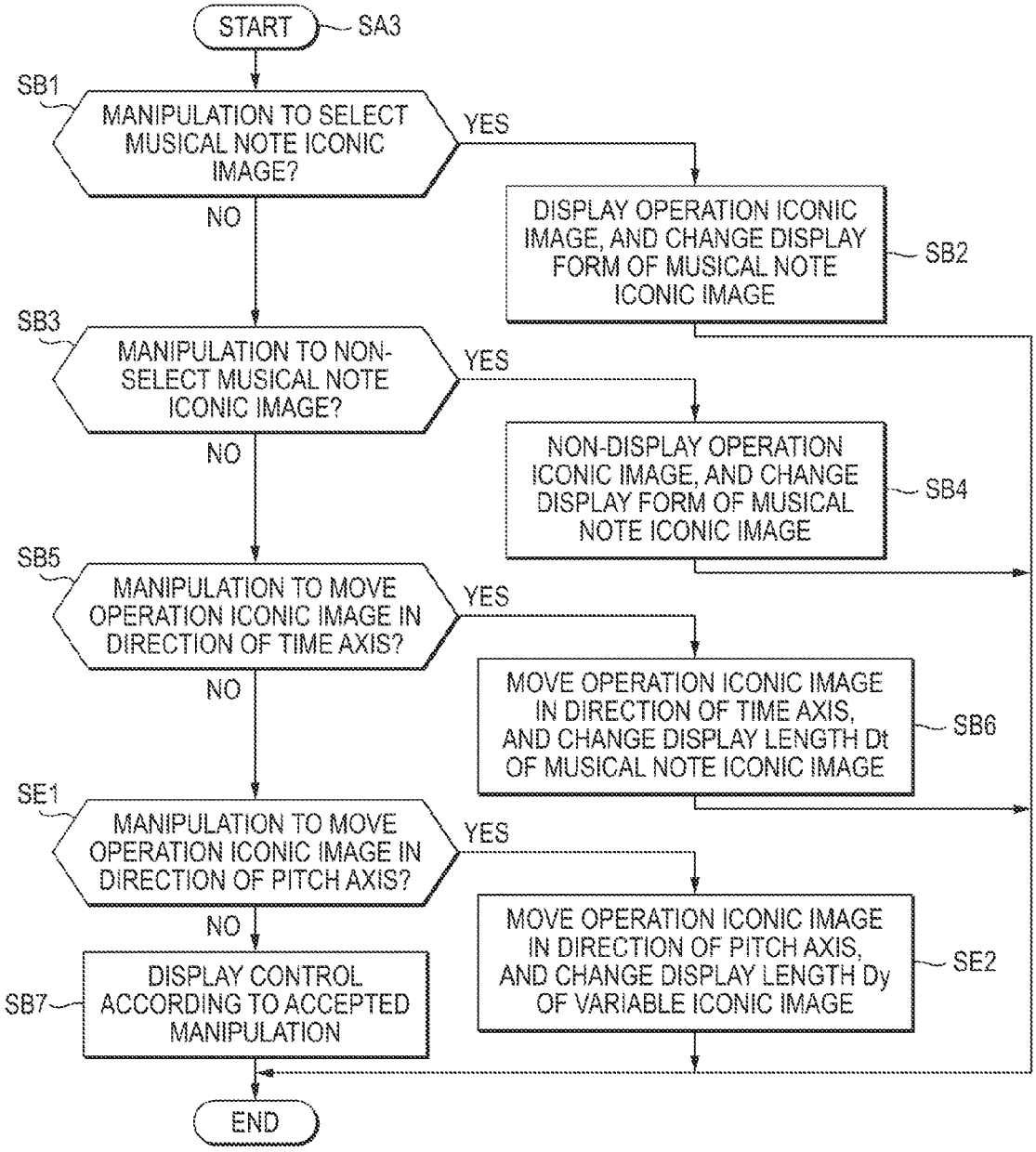
FIG. 11 is a concrete example of the processing of updating the musical note sequence image according to the fourth embodiment.

FIG. 11 is a flowchart of the operation of the arithmetic processing unit 10 in the fourth embodiment. The processing of FIG. 11 is executed instead of the processing of FIG. 6 shown as an example in the first embodiment. In the processing of FIG. 11, step SE1 and step SE2 are added to the processing of FIG. 6. The arithmetic processing unit 10 determines whether the operation accepted at step SA2 of FIG. 5 is a manipulation to move the operation iconic image 46 in the direction of the pitch axis or not (SE1). When a manipulation to move the operation iconic image 46 in the direction of the pitch axis is accepted (SE1: YES), the arithmetic processing unit 10 changes the display length Dy of the variable iconic image 48 corresponding to the selected musical note in the variable area 34 according to the movement amount of the operation iconic image 46 in the direction of the pitch axis (SE2). The rest of the processing executed by the arithmetic processing unit 10 is similar to that of the first embodiment (FIG. 6).

In the fourth embodiment, similar effects to those of the first embodiment are also realized. Moreover, according to the fourth embodiment, since the operation iconic image 46 for changing the display length Dt of the musical note iconic image 42 (the duration TB of the selected musical note) is also used for changing the attribute information NB (variable Y2) of the selected musical note, the effect that the edit of the musical notes is facilitated is significantly remarkable.

While the display length Dy of the variable iconic image 48 (the attribute information NB of the selected musical note) is changed according to the movement of the operation iconic image 46 in the direction of the pitch axis in the above exemplification, the operation for the user to provide an instruction to change the attribute information NB of the selected musical note is not limited to the operation of moving the operation iconic image 46 in the direction of the pitch axis. For example, the following structure may be adopted: a structure in which when the user selects the operation iconic image 46 (for example, when the display screen is tapped), the edit screen for the attribute information NB of the selected musical note is displayed on the display device 14 and an instruction from the user is accepted (that is, a structure in which the movement of the operation iconic image 46 in the direction of the pitch axis is not required). That is, the structure shown as an example as the fourth embodiment is comprehended as the structure in which the attribute information NB of the selected musical note is changed according to an instruction from the user on the operation iconic image 46.

Moreover, while the operation iconic image 46 is used for changing the variable Y2 in the above exemplification, the operation iconic image 46 may be used for editing elements other than the variable Y2. For example, the following structures are suitable: when the operation iconic image 46 is manipulated (for example, the display screen is tapped), the edit screen for the musical note information N of the selected musical note (for example, the sound symbol X3 of the basic information NA or the variable Y1 of the attribute information NB) is displayed on the display device 14 and an instruction from the user is accepted; and the content of the musical note information N (properties of musical notes) is displayed on the display device 14. Moreover, a structure may also be adopted in which when the user repetitively moves the operation iconic image 46 up and down in the direction of the pitch axis, a vibrato (for example, a vibrato of a depth corresponding to the amplitude of the up-and-down movement of the operation iconic image 46) is added to the selected musical note. Moreover, a structure is also suitable in which the operation is changed according to the kind of the operation on the operation iconic image 46. For example, when the operation iconic image 46 is double-tapped, the edit screen for the musical note information N is displayed, and when the operation iconic image 46 is long-tapped, the content of the musical note information N are displayed.

Fifth Embodiment

Figure 12:
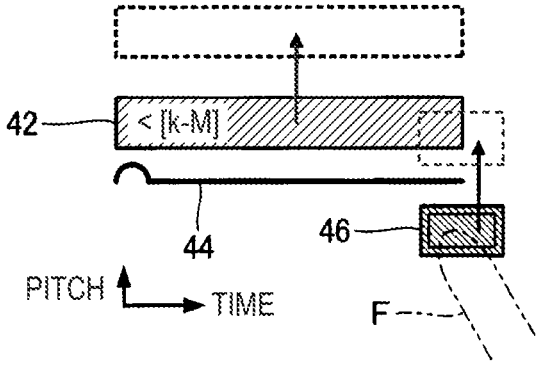
FIG. 12 is an explanatory view of the operation of a fifth embodiment.

FIG. 12 is an explanatory view of the operation of the fifth embodiment. In the fifth embodiment, as in the fourth embodiment, the operation iconic image 46 can be moved also in the direction of the pitch axis according to the operation on the input device 16 as well as the display length Dt of the musical note iconic image 42 of the selected musical note (the duration TB of the selected musical note) is changed according to the movement of the operation iconic image 46 in the direction of the time axis.

The display controller 24 moves the musical note iconic image 42 of the selected musical note in the direction of the pitch axis according to the movement amount of the operation iconic image 46 in the direction of the pitch axis. Specifically, when the user moves the operation iconic image 46 upward (toward the high pitch side in the direction of the pitch axis), as shown in FIG. 12, the display controller 24 moves the musical note iconic image 42 of the selected musical note toward the high pitch side in the direction of the pitch axis by a distance corresponding to the movement amount of the operation iconic image 46. On the other hand, when the user moves the operation iconic image 46 downward (toward the low pitch side in the direction of the pitch axis), the display controller 24 moves the musical note iconic image 42 of the selected musical note toward the low pitch side in the direction of the pitch axis by a distance corresponding to the movement amount of the operation iconic image 46. Moreover, the information manager 26 updates the pitch X1 of the musical note information N of the selected musical note according to the movement of the operation iconic image 46. Specifically, the information manager 26 updates the pitch X1 selected by the musical note information N of the selected musical note to the pitch of the destination of the musical note iconic image 42.

In the fifth embodiment, similar effects to those of the first embodiment are also realized. Moreover, according to the fifth embodiment, since the operation iconic image 46 for changing the display length Dt of the musical note iconic image 42 (the duration TB of the selected musical note) is also used for changing the pitch X1 of the selected musical note, the effect that the edit of the musical notes is facilitated is significantly remarkable.

Figure 13:
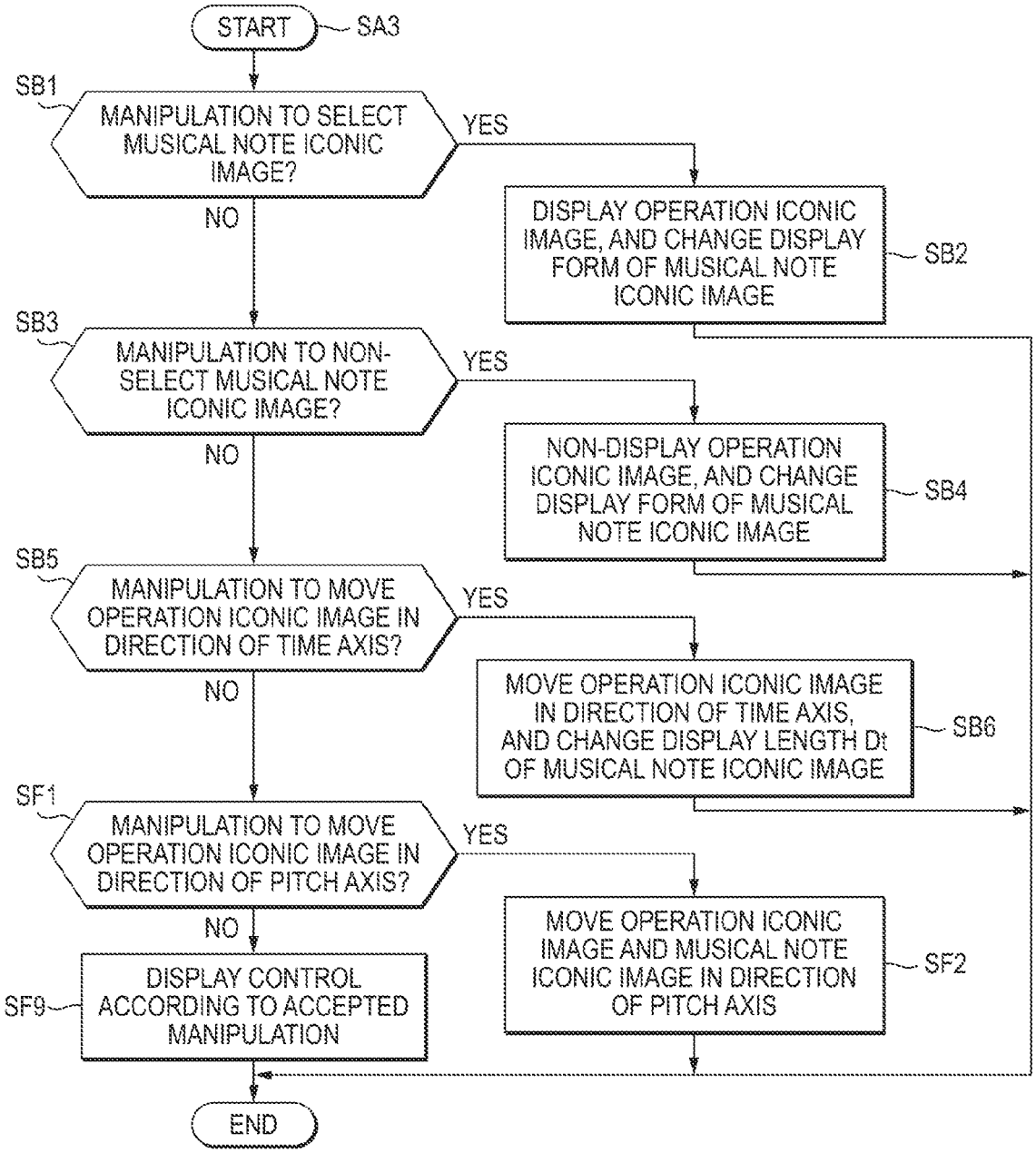
FIG. 13 is a concrete example of the processing of updating the musical note sequence image according to the fifth embodiment.

FIG. 13 is a flowchart of the operation of the arithmetic processing unit 10 in the fifth embodiment. The processing of FIG. 13 is executed instead of the processing of FIG. 6 shown as an example in the first embodiment, in the processing of FIG. 13, step SF1 and step SF2 are added to the processing of FIG. 6. The arithmetic processing unit 10 determines whether the operation accepted at step SA2 of FIG. 5 is a manipulation to move the operation iconic image 46 in the direction of the pitch axis or not (SF1). When a manipulation to move the operation iconic image 46 in the direction of the pitch axis is accepted (SF1: YES), the arithmetic processing unit 10 moves the musical note iconic image 42 of the selected musical note in the direction of the pitch axis by a distance corresponding to the movement amount of the operation iconic image 46 (SF2). The rest of the processing executed by the arithmetic processing unit 10 is similar to that of the first embodiment (FIG. 6).

Sixth Embodiment

In the first embodiment, the display length Dt of the musical note iconic image 42 of the selected musical note is changed according to an instruction from the user on the operation iconic image 46. In the sixth embodiment, according to an instruction from the user on the operation iconic image 46, the display position of the musical note iconic image 42 in the direction of the time axis is changed while the display length Dt of the musical note iconic image 42 is maintained.

Figure 14:
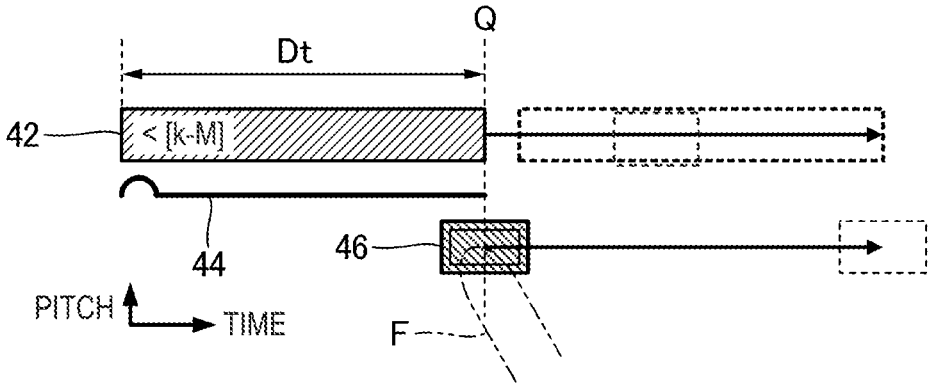
FIG. 14 is an explanatory view of the operation of a sixth embodiment.

FIG. 14 is an explanatory view of the operation of the sixth embodiment. When the user moves the operation iconic image 46 in the positive direction (elapse direction) of the time axis, as shown in FIG. 14, the display controller 24 moves the musical note iconic image 42 of the selected musical note in the positive direction of the time axis by a distance corresponding to the movement amount of the operation iconic image 46. On the other hand, when the user moves the operation iconic image 46 in the negative direction (retrospective direction) of the time axis, the display controller 24 moves the musical note iconic image 42 of the selected musical note in the negative direction of the time axis by a distance corresponding to the movement amount of the operation iconic image 46. The information manager 26 of the sixth embodiment updates, among the music information S, the utterance time TA while maintaining the duration TB of the selected musical note according to the movement of the musical note iconic image 42.

In the sixth embodiment, since the display position of the musical note iconic image 42 in the direction of the time axis is changed by a manipulation on the operation iconic image 46 disposed separately from the musical note iconic image 42, there is an advantage that the edit of the musical notes is easy compared with the structure in which the display position is changed by a direct operation on the musical note iconic image 42.

Figure 15:
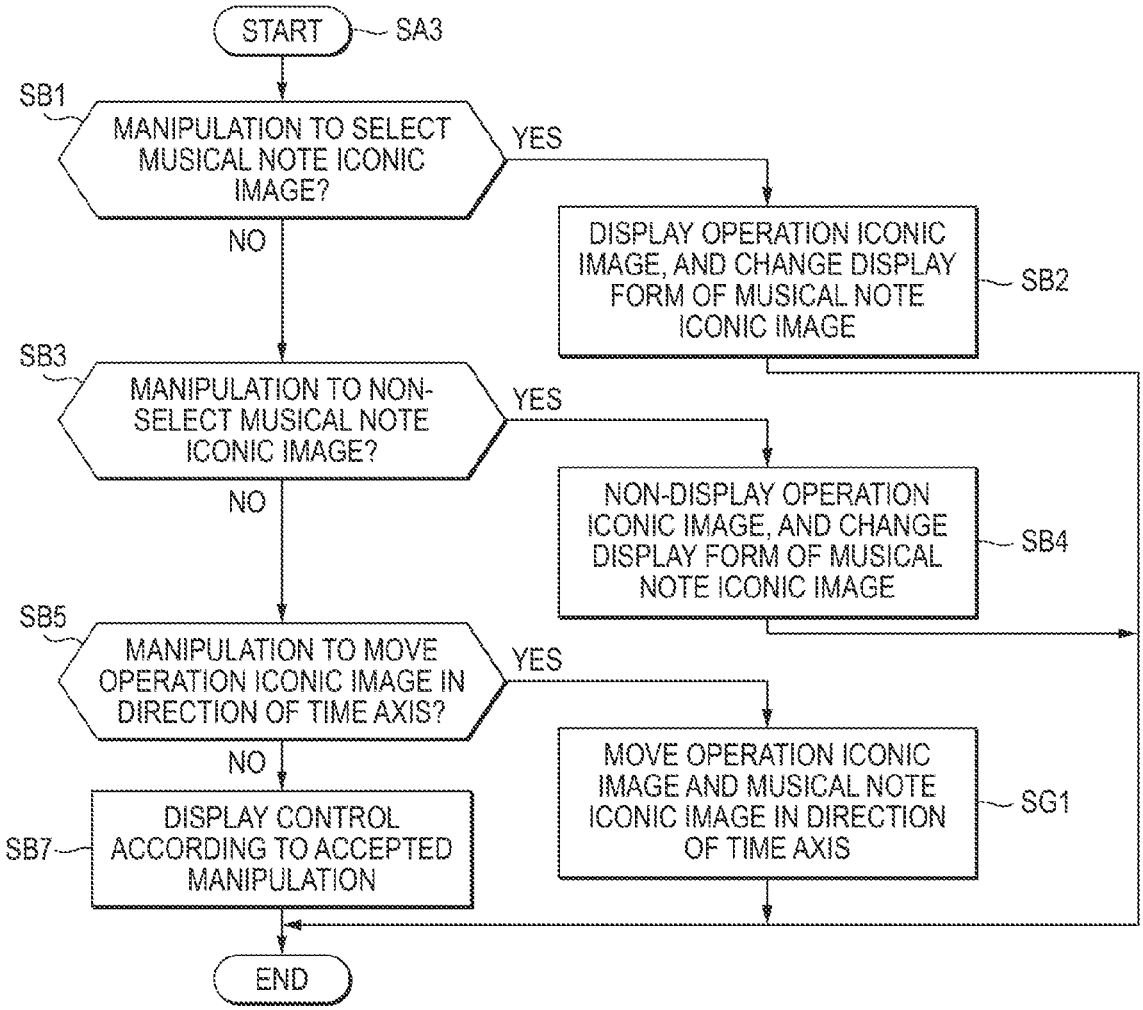
FIG. 15 is a concrete example of the processing of updating the musical note sequence image according to the sixth embodiment.

FIG. 15 is a flowchart of the operation of the arithmetic processing unit 10 in the sixth embodiment. The processing of FIG. 15 is executed instead of the processing of FIG. 6 shown as an example in the first embodiment, in the processing of FIG. 15, step SB6 of the processing of FIG. 6 is replaced with step SG1 of FIG. 15. When a manipulation to move the operation iconic image 46 in the direction of the time axis is accepted (SB5: YES), the arithmetic processing unit 10 moves the musical note iconic image 42 of the selected musical note in the direction of the time axis by a distance corresponding to the movement amount of the operation iconic image 46 (SG1). The rest of the processing executed by the arithmetic processing unit 10 is similar to that of the first embodiment (FIG. 6).

Seventh Embodiment

A song of the seventh embodiment is constituted by a plurality of singing parts corresponding to different singing sounds. The storage device 12 stores a plurality of pieces of music information S corresponding to the different singing parts of the song. That is, the time series of the singing sound (the pitch X1, the utterance period X2, the sound symbol X3) is individually designated for each singing part. The sound synthesizer 22 generates a sound signal of each singing part from the music information S of each singing part of the song, and generates the sound signal V by synthesizing the sound signals of a plurality of singing parts.

Figure 16:
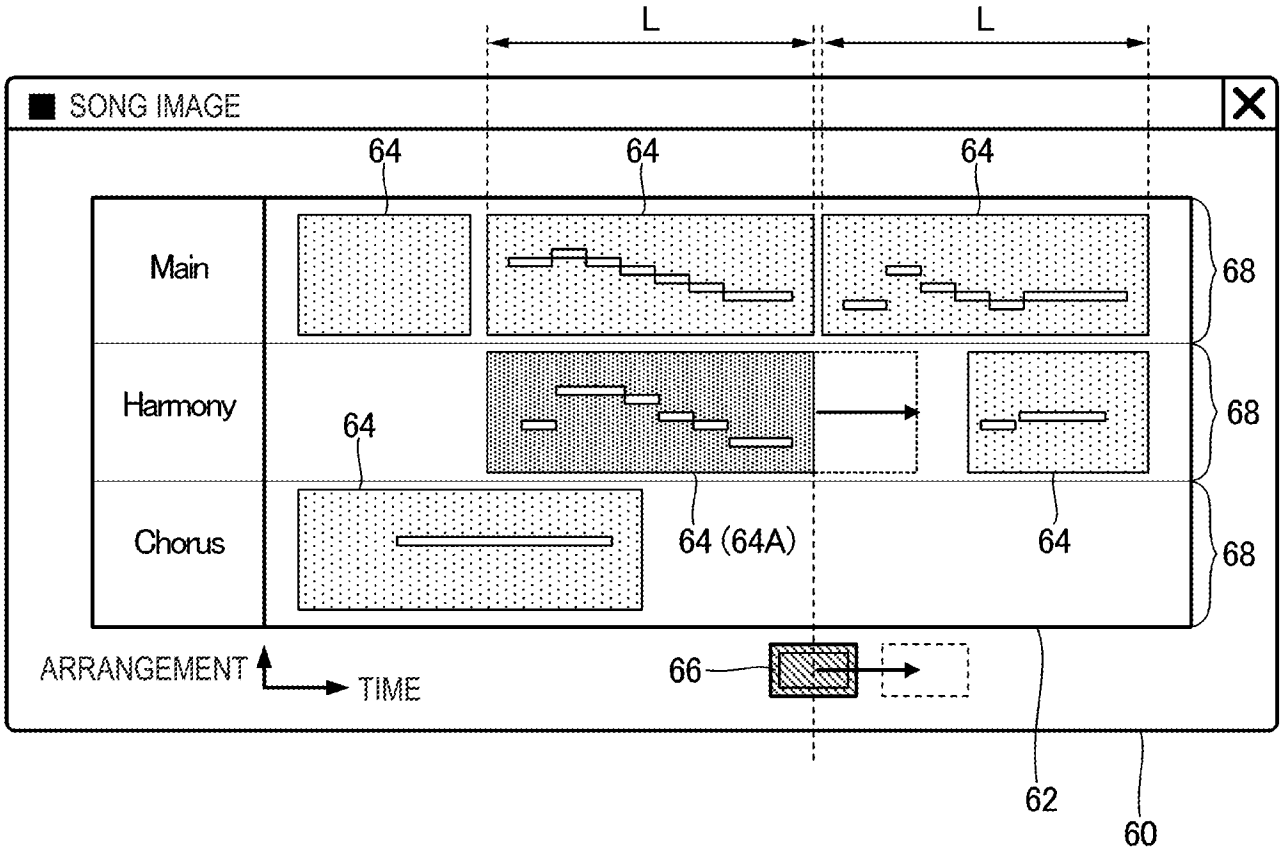
FIG. 16 is a schematic view of a song image.

The display controller 24 of the present embodiment displays on the display device 14 a song image 60 of FIG. 16 for the user to check the singing sounds of a plurality of singing parts of the song. The song image 60 includes a song area 62, edit object sections 64 and a section operation iconic image 66. In the song area 62, a time axis (lateral axis) and an arrangement axis (longitudinal axis) that intersect each other are set. Time points on the time axis in the song area 62 correspond to time points of the song.

The song area 62 is sectionalized into a plurality of unit areas 68 corresponding to the different singing parts of the song. The unit areas 68 are each a belt-like area extending along the time axis, and a plurality of unit areas 68 are arranged in parallel in the direction of the arrangement axis. FIG. 16 illustrates the unit areas 68 corresponding to the singing part of a main melody (Main) of the song, the singing part of a sub melody (Harmony) of the song and the singing part of a chorus sound (Chorus), respectively.

By appropriately manipulating the input device 16, the user can designate, as the edit object sections 64, any sections on the time axis in the unit area 68 corresponding to a desired singing part and select any single edit object section 64 (hereinafter, referred to as "designated edit object section 64A) from among a plurality of designated edit object sections 64. The display controller 24 displays the edit object sections 64 designated by the user in a form (for example, color or gradation) different from that of the remaining sections of the unit areas 68, and displays the designated edit object section 64A selected by the user from among a plurality of edit object sections 64 in a form different from that of the other edit object sections 64.

When the user designates the designated edit object section 64A of a desired singing part by manipulating the input device 16 (for example, double-tapping the designated edit object section 64A), the display controller 24 displays the musical note sequence image 30 corresponding to the designated edit object section 64A on the display device 14. That is, of one singing part corresponding to the designated edit object section 64A of the song, the musical note sequence image 30 for editing the musical note sequence in the designated edit object section 64A is displayed on the display device 14. The information manager 26, as in the first embodiment, accepts an instruction from the user on the musical note sequence image 30, and generates or updates the music information S of the singing part corresponding to the designated edit object section 64A according to the instruction from the user. When the user having edited the musical note sequence in the designated edit object section 64A applies a predetermined operation to the input device 16, the display controller 24 re-displays the song image 60 on the display device 14. As illustrated in FIG. 16, an image representing the musical note sequence having edited on the musical note sequence image 30 is added to the edit object section 64. Consequently, by visually checking the song image 60, the user can check the overview of the musical note sequences over a plurality of singing parts and the relevance among the musical note sequences of the singing parts. It is impossible to directly edit the music information S by a manipulation on the edit object section 64 (the song image 60).

The section operation iconic image 66 is disposed in a position corresponding to the designated edit object section 64A and accepts an instruction from the user. Specifically, the section operation iconic image 66 is disposed in a position being away from the song area 62 by a predetermined distance on a straight line in the direction of the arrangement axis passing the tail end of the edit object section 64. The display controller 24 changes the display length L of the edit object section 64 in the direction of the time axis according to an instruction from the user on the section operation iconic image 66. Specifically, the user can move the section operation iconic image 66 in the direction of the time axis by a manipulation on the input device 16 (for example, drag on the display screen). The display controller 24 changes (elongates or contracts) the display length L of the edit object section 64 in the direction of the time axis according to the movement amount of the section operation iconic image 66. As is understood from the above description, the user can appropriately change the section to be displayed and edited on the musical note sequence image 30 of a specific singing part of the song (the display length L of the designated edit object section 64A), by a manipulation on the section operation iconic image 66.

Figure 17:
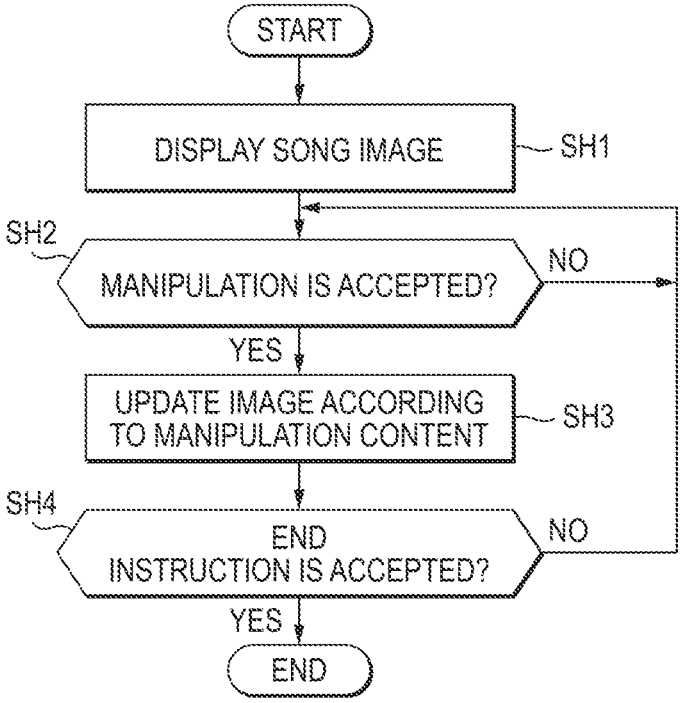
FIG. 17 is a flowchart showing the operation of a sound synthesizing apparatus according to a seventh embodiment.

FIG. 17 is a flowchart of the operation of the arithmetic processing unit 10 in the seventh embodiment. For example, the processing of FIG. 17 is started when an instruction to display the song image 60 is provided by the user. The arithmetic processing unit 10 displays the song image 60 on the display device 14 (SH1), and waits for an operation from the user on the input device 16 (SH2). When a manipulation from the user is accepted (SH2: YES), the arithmetic processing unit 10 changes the content of the song image 60 according to the content of the operation (SH3). The arithmetic processing unit 10 repeats the above processing until an instruction to end the operation on the song image 60 is provided by the user (SH4: NO), and when the end instruction is accepted (SH4: YES), the arithmetic processing unit 10 ends the processing of FIG. 17.

Figure 18:
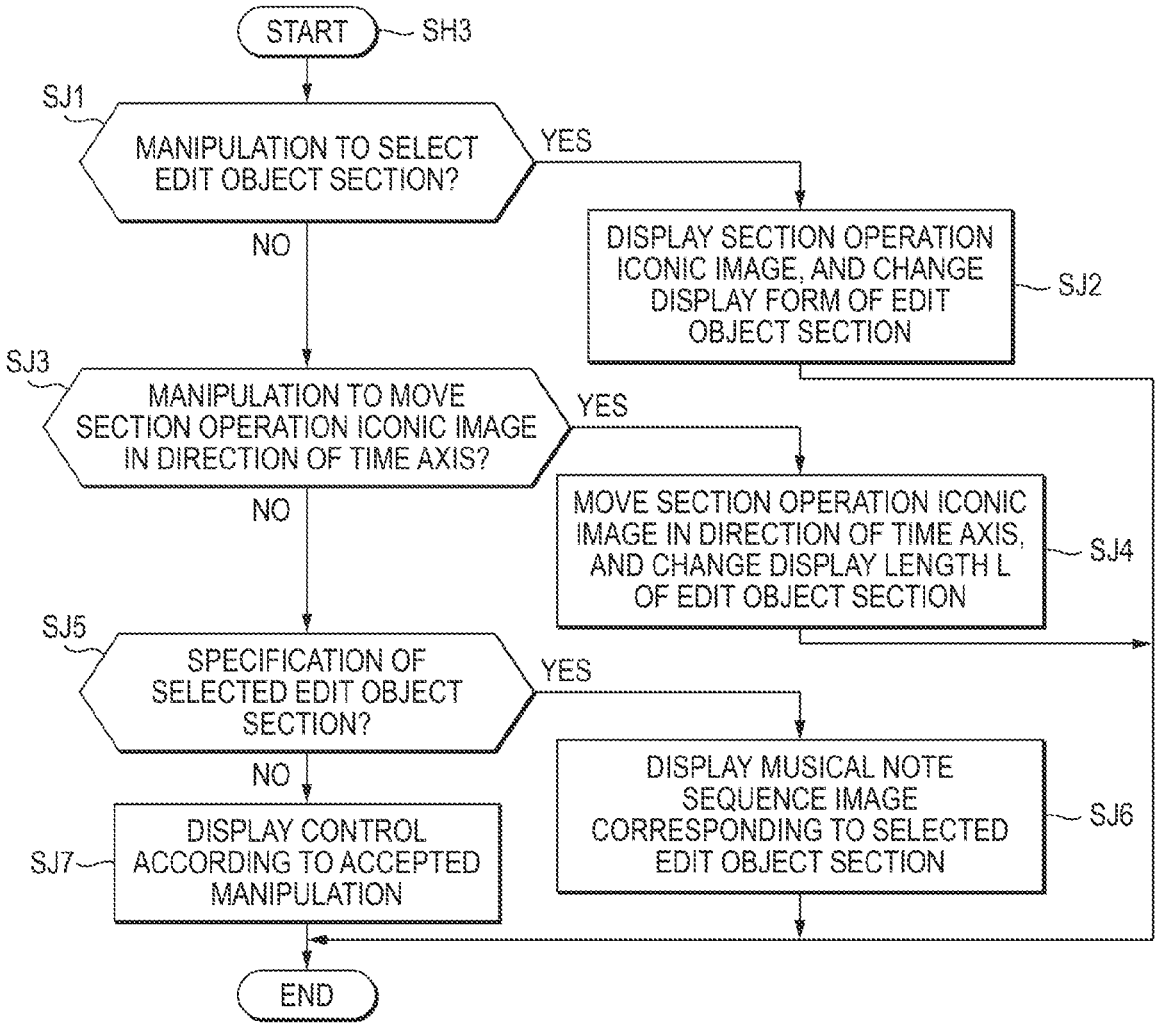
FIG. 18 is a concrete example of the processing of updating the song image according to the seventh embodiment.

FIG. 18 is a flowchart of a concrete example of the processing (step SH3 of FIG. 17) in which the arithmetic processing unit 10 (the display controller 24) controls the display of the display device 14 when a manipulation from the user on the input device 16 is accepted. The arithmetic processing unit 10 determines whether the operation accepted from the user is a manipulation to select the edit object section 64 in the song area 62 or not (SJ1). When selection of the edit object section 64 is accepted (SJ1: YES), the arithmetic processing unit 10 disposes the section operation iconic image 66 corresponding to the designated edit object section 64A and displays the designated edit object section 64A in a display form (for example, color or gradation) different from the non-selected edit object sections 64 (SJ2). On the other hand, when selection of the edit object section 64 is not accepted (SJ1: NO), the arithmetic processing unit 10 determines whether the operation accepted from the user is a manipulation to move the section operation iconic image 66 in the direction of the time axis or not (SJ3). When a manipulation to move the section operation iconic image 66 in the direction of the time axis is accepted (SJ3: YES), the arithmetic processing unit 10 changes the display length L of the designated edit object section 64A in the direction of the time axis according to the movement amount of the section operation iconic image 66 (SJ4).

When an instruction to move the section operation iconic image 66 is not provided (SJ3: NO), the arithmetic processing unit 10 determines whether specification of the designated edit object section 64A is accepted from the user or not (SJ5). When specification of the designated edit object section 64A is accepted (SJ5: YES), by executing the above-described processing of FIG. 5, the arithmetic processing unit 10 displays the musical note sequence image 30 corresponding to the designated edit object section 64A on the display device 14, and updates the musical note sequence image 30 according to the instruction from the user (SJ6). When a manipulation other than the operation described above as an example is accepted (SJ5: NO), the arithmetic processing unit 10 changes the content of the song image 60 according to the operation by the user (SJ7), and ends the processing of FIG. 17 (step SH3 of FIG. 5).

In the seventh embodiment, effects similar to those of the first embodiment are realized. Moreover, in the seventh embodiment, since the song image 60 including the song area 62 and the edit object sections 64 is displayed, it is easy to grasp the musical note sequence over the entire song. Moreover, by operating the section operation iconic image 66 displayed separately from the edit object sections 64 of the song image 60, the display length L of the edit object section 64 (the designated edit object section 64A) in the direction of the time axis is changed. With the above structure, even when the user touches the display screen with a finger to move the section operation iconic image 66, the designated edit object section 64A is not hidden behind the finger, so that an advantage is also produced that the user can easily change the display length L of the designated edit object section 64A while checking the position and display length L of the designated edit object section 64A on the time axis and the relationship with the other edit object sections 64.

<Modifications>

The above-described embodiments may be modified variously. Concrete modifications will be shown below as examples. Two or more embodiments arbitrarily selected from among the following exemplifications may be combined as appropriate.

(1) While the operation iconic image 46 is disposed in a predetermined position with respect to the musical note iconic image 42 of the selected musical note (hereinafter referred to as "reference position") in the above-described embodiments, there can be a case where it is inappropriate to dispose the operation iconic image 46 in the reference position with respect to the musical note iconic image 42. Accordingly, a structure is suitably adopted whether the operation iconic image 46 is disposed in the reference position with respect to the musical note iconic image 42 of the selected musical note or not is switched according to whether a predetermined condition related to whether the disposition of the operation iconic image 46 is appropriate or not is met. For example, it is possible to dispose the operation iconic image 46 in the reference position with respect to the musical note iconic image 42 of the selected musical note when the predetermined condition is met and dispose the operation iconic image 48 in a position different from the reference position when the predetermined condition is not met.

Figure 19:
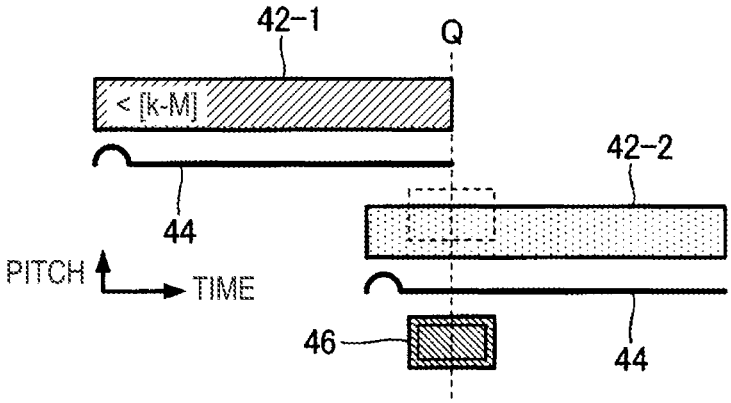
FIG. 19 is an explanatory view of the operation in a modification.

For example, as shown in FIG. 19, when a predefined musical note iconic image 42-2 is present in the reference position (the broken line part in FIG. 19) with respect to a musical note iconic image 42-1 at the point of time when the user selects the musical note iconic image 42-1, if the operation iconic image 46 is disposed in the reference position, the operation iconic image 46 and the musical note iconic image 42-2 overlap each other to make it difficult for the user to check them independently. Accordingly, when the predefined musical note iconic image 42-2 is disposed in the reference position with respect to the musical note iconic image 42-1 of the selected musical note, as shown in FIG. 19, the display controller 24 disposes the operation iconic image 46 in a position not overlapping the musical note iconic image 42-2 (a position different from the reference position). FIG. 19 shows as an example a case where the operation iconic image 46 is disposed in a position not overlapping the musical note iconic image 42-2 or the edit image 44 in the vicinity thereof on the straight line Q in the direction of the pitch axis, the straight line Q passing the tail end of the musical note iconic image 42-1 of the selected musical note (a position below the musical note iconic image 42-2).

Figure 20:
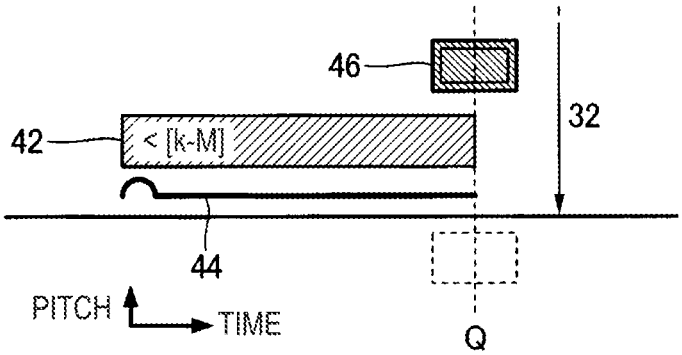
FIG. 20 is an explanatory view of the operation in a modification.

Moreover, a structure is suitable in which, for example as shown in FIG. 20, when the reference position (the broken line part in FIG. 20) with respect to the musical note iconic image 42 selected by the user is situated outside the musical score area 32, the display controller 24 disposes the operation iconic image 46 in a specific position (a position different from the reference position) in the musical score area 32. FIG. 20 shows as an example a case where the operation iconic image 46 is disposed in a position above the musical note iconic image 42 on the straight line Q in the direction of the pitch axis, the straight line Q passing the tail end of the musical note iconic image 42 of the selected musical note.

As is understood from the above exemplification, a structure is suitable in which the operation iconic image 46 is disposed in a blank area of the musical score area 32 situated in the vicinity of the musical note iconic image 42 of the selected musical note (that is, an area in the musical score area 32 where neither the predefined musical note iconic image 42 nor the edit image 44 is disposed). According to the above-described structures, since the operation iconic image 46 is disposed in an appropriate position (a position not overlapping another musical note iconic images 42 or a position inside the musical score area 32), the effect that the edit of the musical notes is easy is significantly remarkable.

Figure 21:
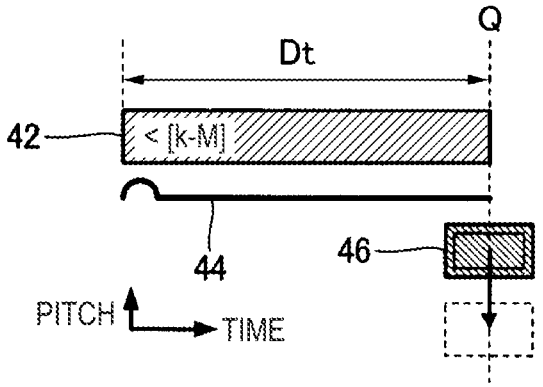
FIG. 21 is an explanatory view of the operation in a modification.

Moreover, a structure in which the user can select the position of the operation iconic image 46 is also suitable. For example as shown in FIG. 21, the display controller 24 moves the operation iconic image 46 disposed in the reference position with respect to the musical note iconic image 42 of the selected musical note, to an arbitrary position in the direction of the pitch axis according to the operation of the input device 16 by the user (for example, dragging the operation iconic image 46 in the direction of the pitch axis). The position and display length Dt of the musical note iconic image 42 do not change before and after the movement of the operation iconic image 46. According to this structure, since the operation iconic image 46 is moved to a position desired by the user, the effect that the edit of the musical notes is easy is significantly remarkable.

(2) While whether to display the operation iconic image 46 or not is controlled according to the presence or absence of a selection by the user in the first embodiment and whether to display the operation iconic image 46 or not is controlled according to the display magnification R in the second embodiment, the method of controlling whether to display the operation iconic image 46 or not is not limited to the above exemplifications. For example, when the tail end of the musical note iconic image 42 of the selected musical note is situated outside the musical score area 32 (when the tail end is not displayed), the operation iconic image 46 may be non-displayed. Moreover, a structure is adopted in which the operation iconic image 46 is not displayed for the musical note iconic image 42 of the selected musical note the display length Dt of which is lower than a predetermined value.

Figure 22:
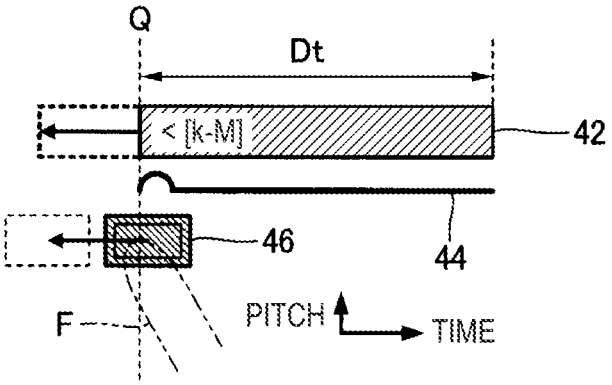
FIG. 22 is an explanatory view of the operation in a modification.

(3) While the operation iconic image 46 is disposed in the vicinity of the tail end of the musical note iconic image 42 of the selected musical note in the above-described embodiments, a structure is also adopted in which as shown in FIG. 22, the operation iconic image 46 is disposed in the vicinity of the starting end of the musical note iconic image 42 and the position of the starting end (the utterance time TA) of the musical note iconic image 42 in the direction of the time axis is moved in conjunction with the movement of the operation iconic image 46 in the direction of the time axis. According to this structure, the position of the starting end and the display length Dt of the musical note iconic image 42 (the utterance time TA and the duration TB of the selected musical note) are changed according to the movement of the operation iconic image 46. Moreover, a separate operation iconic image 46 may be disposed in the vicinity of each of the starting end and the tail end of the musical note iconic image 42 so that the starting end or the tail end of the musical note iconic image 42 is moved according to the movement of the operation iconic image 46. In the structure of FIG. 22, it is possible to change only the position of the musical note iconic image 42 in the direction of the time axis according to the position of the operation iconic image 46 (the display length Dt is not changed).

(4) In the structure in which the operation iconic image 46 is disposed in the vicinity of the tail end of the musical note iconic image 42 of the selected musical note, a structure is also adopted in which when the musical note iconic image 42 of the selected musical note is situated in the vicinity of the right end in the musical score area 32, the position of the operation iconic image 46 with respect to the musical note iconic image 42 is moved leftward compared with the normal position the position of the operation iconic image 46 when the musical note iconic image 42 is situated in a central part of the musical score area 32). Moreover, in the structure in which the operation iconic image 46 is disposed in the vicinity of the starting end of the musical note iconic image 42 of the selected musical note like the exemplification of FIG. 22, a structure is also adopted in which when the musical note iconic image 42 of the selected musical note is situated in the vicinity of the left end in the musical score area 32, the position of the operation iconic image 46 with respect to the musical note iconic image 42 is moved rightward compared with the normal position.

(5) In the second embodiment, the operation iconic image 46 is non-displayed when the display magnification R is low. However, a situation can be assumed in which when the display magnification R is low, the musical note iconic image 42 and the edit image 44 are reduced and apt to be hidden behind the user's finger F. Accordingly, a structure may also be adopted in which when the display magnification R is lower than the threshold value RTH (zoom-out), the operation iconic image 46 is disposed in the vicinity of the musical note iconic image 42 of the selected musical note and when the display magnification R is higher than the threshold value RTH (zoom-in), the operation iconic image 46 is not disposed in the vicinity of the musical note iconic image 42 of the selected musical note.

(6) The method for the user to select the musical note is not limited to the above mentioned example. For example, in addition to the method of the above-described embodiments in which the musical note is selected by designating the desired musical note iconic image 42 in the musical score area 32 (for example, touching the display screen), the following methods may be adopted: a method in which the user designates the desired variable iconic image 48 in the variable area 34 to thereby select the musical note corresponding to the variable iconic image 48 as the selected musical note; and a method in which the user designates the desired edit image 44 in the musical score area 32 to thereby select the musical note corresponding to the edit image 44 as the selected musical note.

The elements shown as examples in the above-described embodiments may be omitted as appropriate. For example, the structure in which the display length Dt of the musical note iconic image 42 (the display length Dt of the selected musical note) is changed according to the movement of the operation iconic image 46 may be omitted from the fourth embodiment and the fifth embodiment. That is, the fourth embodiment is identified as a structure in which the attribute information NB of the selected musical note is changed according to the movement of the operation iconic image 46, and the fifth embodiment is identified as a structure in which the pitch X1 of the selected musical note is changed according to the movement of the operation iconic image 46.

Figure 23:
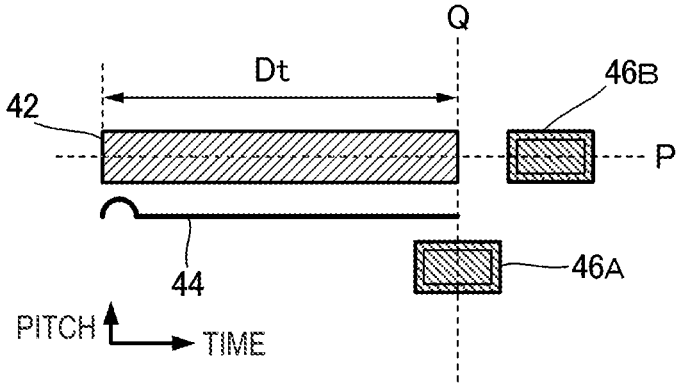
FIG. 23 is an explanatory view of the operation in a modification.

Moreover, the operation iconic image 46 may be independently disposed for each element (variable) to be controlled. For example, a structure may be adopted in which the operation iconic image 46 for editing the display length Dt of the musical note iconic image 42 (the duration TB of the selected musical note), the operation iconic image 46 for editing the pitch X1 of the selected musical note and the operation iconic image 46 for editing the attribute information NB of the selected musical note are disposed in the vicinity of the musical note iconic image 42 of the selected musical note. FIG. 23 illustrates a case where an operation iconic image 46A for editing the display length Dt of the musical note iconic image 42 and an operation iconic image 46B for editing the pitch X1 of the selected musical note are disposed in the vicinity of the musical note iconic image 42 of the selected musical note. The operation iconic image 46B is disposed, for example, on a straight line P on the time axis passing the barycenter of the musical note iconic image 42 and in the vicinity of the musical note iconic image 42. According to the movement of the operation iconic image 46A of FIG. 23 on the time axis, the display length Dt of the musical note iconic image 42 of the selected musical note is changed (elongated or contracted), and according to the movement of the operation iconic image 46B on the pitch axis, the position of the musical note iconic image 42 of the selected musical note on the pitch axis (pitch X1) is changed.

(8) While the display length Dt of the musical note iconic image 42 (the duration TB of the selected musical note) is changed according to the movement of the operation iconic image 48 in the direction of the time axis in the first embodiment, the display length Dy of the variable iconic image 48 (the numerical value of the variable Y2) is changed according to the movement of the operation iconic image 46 in the direction of the pitch axis in the fourth embodiment and the position of the musical note iconic image 42 in the direction of the pitch axis (the pitch X1 of the selected musical note) is changed according to the movement of the operation iconic image 46 in the direction of the pitch axis in the fifth embodiment, the relationship between the content of the operation on the operation iconic image 46 (for example, the movement direction of the operation iconic image 46) and the object to be controlled is changed as appropriate. Specifically, a structure is adopted in which the attribute information NB (variable Y2) that differs between when the operation iconic image 46 is moved in the direction of the time axis and when it is moved in the direction of the pitch axis is updated according to the movement amount of the operation iconic image 46. For example, it is possible to update the volume (variable Y2) when the operation iconic image 46 moves in the direction of the time axis and update the articulation when the operation iconic image 46 moves in the direction of the pitch axis. Moreover, a structure may also be adopted in which the attribute information NB (the display length Dy of the variable iconic image 48) is updated according to the movement of the operation iconic image 46 in the direction of the time axis and the position of the musical note iconic image 42 in the direction of the pitch axis (the pitch X1 of the selected musical note) is updated according to the movement of the operation iconic image 46 in the direction of the pitch axis. Moreover while in the third embodiment, the display length Dt of the musical note iconic image 42 in the selected area 50 is changed in accordance with the movement of the operation iconic image 46, a structure may also be adopted in which the display position of each musical note iconic image 42 in the selected area 50 in the direction of the time axis is changed in conjunction with the movement of the operation iconic image 46.

(9) While the rectangular operation iconic image 46 is shown as an example in the above-described embodiments, the form of the operation iconic image 46 is not limited to the above-described embodiments. For example, an operation iconic image 46 (icon) to which a symbol or an iconic image representative of the object (for example, the duration TB) to be controlled by a manipulation on the operation iconic image 46 is added or an operation iconic image 46 to which the numerical value of the object (for example, the numerical value of the duration TB) to be controlled by a manipulation on the operation iconic image 46 is added may be disposed.

(10) The operation iconic image 46 may be moved in an oblique direction (a direction inclined with respect to the time axis and the pitch axis) according to an instruction from the user. When the operation iconic image 46 moves in an oblique direction, the movement component in the direction of the time axis corresponds to the "movement in the direction of the time axis" in the above-described embodiments, and the movement component in the direction of the pitch axis corresponds to the "movement in the direction of the pitch axis" in the above-described embodiments. As is understood from the above description, the "movement of the operation iconic image in the direction of the time axis" is a concept embracing the movement component in the direction of the time axis when the operation iconic image moves, for example, in an oblique direction in addition to the linear movement only in the direction of the time axis. Likewise, the "movement of the operation iconic image in the direction of the pitch axis" is a concept embracing the movement component in the direction of the pitch axis when the operation iconic image moves, for example, in an oblique direction in addition to the linear movement only in the pitch direction.

While the operation iconic image 46 is disposed on the straight line Q parallel to the pitch axis in the above-described embodiments, the direction of the straight line Q is changed as appropriate. For example, the operation iconic image 46 may be disposed on the straight fine Q parallel to the pitch axis, a straight line Q forming a predetermined angle with respect to the time axis or the pitch axis (that is, a straight line inclined with respect to the time axis or the pitch axis). The operation iconic image 46 can move along the straight line Q according to an instruction from the user. From the viewpoint of preventing the musical note iconic image 42 from being hidden behind the user's finger F, for example, the following structures are suitable: a structure in which the operation iconic image 46 is disposed on the lower right side of the tail end of the musical note iconic image 42; and a structure in which the operation iconic image 46 is disposed on the lower left side of the starting end of the musical note iconic image 42.

(11) While the music information S used for sound synthesis is shown as an example in the above-described embodiments, the music information S is not limited to data applied to sound synthesis. For example, the present disclosure is also applicable to a case where the music information S representative of the musical score of a song is displayed on the display device 14 (the presence or absence of sound synthesis is disregarded). Therefore, the sound synthesizer 22 and the information manager 26 in the above-described embodiments are not essential to the present disclosure, and the sound symbol X3 and the attribute information NB may be omitted. As is understood from the above description, the present disclosure is comprehended as a music information display control apparatus provided with a display controller (for example, the display controller 24 of the above-described embodiments) for displaying, on the display device 14, the musical note sequence image 30 in which the musical note iconic image 42 of each musical note and the operation iconic image 46 that accepts an instruction from the user are arranged in the musical score area 32 where the pitch axis and the time axis are set.

(12) in the above-described embodiments, a plurality of operation iconic images 46, having different control content at the time of operation to each other, may be disposed in the vicinity of the musical note iconic image 42. For example, it is considered that, in a case that different operation iconic images 46 are disposed in the vicinities of a tail end and a starting end of the musical note iconic image 42 respectively, the display length Dt of the musical note iconic image 42 is changed according to a manipulation on the operation iconic image 46 disposed in the vicinity of the tail end, and the position of the musical note iconic image 42 in the direction of the time axis is changed according to a manipulation on the operation iconic image 46 disposed in the vicinity of the tail end. Moreover, for example, it is considered to dispose different operation iconic images 46 in the center of the musical note iconic image 42 in the direction of the time axis and the vicinity of the tail end (or the starting end) of the musical note iconic image 42, and the display length Dt of the musical note iconic image 42 is changed according to a manipulation on the operation iconic image 46 disposed in the vicinity of the tail end and the position of the musical note iconic image 42 in the direction of the time axis is changed according to a manipulation on the operation iconic image 46 disposed in the center of the musical note iconic image 42. A plurality of operation iconic images 46 corresponding to different operation content may be displayed in different display forms, respectively.

(13) While the straight line Q and the straight line P are illustrated for convenience in the above-described embodiments, the straight line Q and the straight line P may be actually displayed on the display device 14 as auxiliary lines for clarifying the positional relationship between the musical note iconic image 42 and the operation iconic image 46. The display controller 24 moves the auxiliary lines in conjunction with the movement of the operation iconic image 46.

(14) The embodiments exemplifying the control of the musical note iconic image 42 according to a manipulation on the operation iconic image 46 are similarly applied to the control of the edit object section 64 according to a manipulation on the section operation iconic image 66. For example, as in the fifth embodiment in which the musical note iconic image 42 is moved in the direction of the pitch axis according to an instruction to move the operation iconic image 46 in the direction of the pitch axis, in the seventh embodiment, the edit object section 64 may be moved in the direction of the arrangement axis (that is, the designated edit object section 64A may be moved to another unit area 68) according to an instruction to move the section operation iconic image 66 in the direction of the arrangement axis. Moreover, as in the sixth embodiment in which the musical note iconic image 42 is moved in the direction of the time axis according to an instruction to move the operation iconic image 46 in the direction of the time axis, in the seventh embodiment, the edit object section 64 may be moved in the direction of the time axis according to an instruction to move the section operation iconic image 66 in the direction of the time axis.

(15) In the seventh embodiment, the content of the control of the section operation iconic image 66 according to an instruction from the user are not limited to the above-described example (change of the display length L of the designated edit object section 64A). Specifically, the music information S corresponding to each musical note in the designated edit object section 64A may be changed according to an instruction to move the section operation iconic image 66 in the direction of the time axis or in the direction of the arrangement axis. For example, the pitch X1 or a variable of the attribute information NB (for example, the variable Y2 that defines the volume) of each musical note in the designated edit object section 64A may be changed. Moreover the display magnification of the song area 62 (the edit object sections 64) may be changed according to an instruction to move the section operation iconic image 68 in the direction of the arrangement axis.

(16) While in the seventh embodiment, when the user selects a desired designated edit object section 64A, the musical note sequence image 30 similar that of the first embodiment corresponding to the designated edit object section 64A is displayed on the display device 14, the musical note sequence image 30 displayed in the seventh embodiment is not limited to the above-described examples. For example, the musical note sequence image 30 where the operation iconic image 46 is omitted may be displayed. That is, the structure of the first to sixth embodiments in which the display of the musical note iconic image 42 is controlled according to an instruction on the operation iconic image 46 is not essential for the structure in which the display of the edit object section 64 is controlled according to an instruction on the section operation iconic image 66.

Here, the above embodiments are summarized as follows.

There is provided a music information display control method comprising:

displaying, on a display device, a musical note sequence image in which a musical note iconic image of each musical note is disposed in a musical score area where a pitch axis and a time axis are set;

disposing an operation iconic image in a vicinity of the musical note iconic image;

accepting an instruction from a user on the operation iconic image; and changing a display length or a display position of the musical note iconic image in a direction of the time axis according to the instruction to move the operation iconic image.

According to this structure, since the display length or the display position of the musical note iconic image is changed by a manipulation on the operation iconic image disposed separately from the musical note iconic image, there is an advantage that the edit of the musical notes is easy compared with the structure that the display length or the display position is changed by a direct manipulation on the musical note iconic image.

The vicinity of the musical note iconic image indicates a position where the user can visually identify, in the musical score area, the musical note iconic image corresponding to the operation iconic image. For example, the operation iconic image is disposed in the vicinity of an end (for example, the starting end or the tail end in the direction of the time axis) of the musical note iconic image. For example, the following structure may be considered: a structure that the operation iconic image is disposed on a straight line passing an and of the musical note iconic image and forming a predetermined angle (for example, a right angle) with respect to the time axis or the pitch axis (for example, a structure that the position, on the time axis or on the pitch axis, of the point of barycenter of the operation iconic image coincides with an end of the musical note iconic image). Moreover, both a position where the operation iconic image partially overlaps the musical note iconic image and a position where the operation iconic image is away from the musical note iconic image (a position away from the musical note iconic image by a predetermined distance in the direction of the time axis or in the direction of the pitch axis) may be embraced by the concept of the "vicinity of the musical note iconic image".

For example, the display controller disposes the operation iconic image in the vicinity of an end of the musical note iconic image in the direction of the time axis, and changes the position of the end according to the instruction to move the operation iconic image in the direction of the time axis. According to this structure, since the end of the musical note iconic image moves according to the movement of the operation iconic image disposed in the vicinity of the end, there is an advantage that the user can intuitively grasp the relationship between the operation on the operation iconic image and the change of the musical note iconic image.

For example, the display controller switches between display and non-display of the operation iconic image. In this case, since switching between display and non-display of the operation iconic image is made, there is an advantage that the musical note sequence image is inhibited from becoming complicated (the musical note iconic images can be easily checked), for example, compared with the structure that the operation iconic image corresponding to each musical note iconic image is fixedly displayed. For example, the following structures are suitably adopted: a structure that the operation iconic image is disposed in the vicinity of the musical note iconic image selected by the user and the operation iconic image is not disposed for the non-selected musical notes: and a structure that switching between display and non-display of the operation iconic image is made according to the display magnification of the musical score area. However, the operation iconic image corresponding to each musical note iconic image may be fixedly displayed.

For example, when the user selects a plurality of musical note iconic images in the musical score area, the display controller disposes one operation iconic image for the musical note iconic images, and changes the display length or the display position, in the direction of the time axis, of at least one of the musical note iconic images according to the instruction to move the operation iconic image in the direction of the time axis. In this case, one operation iconic image is disposed for a plurality of musical note iconic images selected by the user, and at least one musical note iconic image is changed according to an operation on the operation iconic image. Consequently, there is an advantage that the load on the user when a plurality of musical note iconic images are edited at a time is reduced.

For example, the music information display control apparatus comprises an information manager configured to manage, for each musical note, basic information designating a pitch and an utterance period of the musical note and attribute information designating a musical expression of the musical note, and the information manager changes the attribute information of the musical note corresponding to the musical note iconic image according to an instruction from the user on the operation iconic image in the vicinity of the musical note iconic image. For example, a structure is suitable in which according to an instruction to move the operation iconic image in the vicinity of a musical note iconic image in the direction of the pitch axis, the attribute information of the musical note corresponding to the musical note iconic image is changed.

For example, according to an instruction from the user on the operation iconic image, the display controller changes the position of the operation iconic image in the direction of the pitch axis while maintaining the position and display length of the musical note iconic image. According to this case, since the position of the operation iconic image in the direction of the pitch axis is changed according to an instruction from the user, the operation iconic image can be moved to a position where it is easy for the user to visually recognize and operate it. Moreover, a structure is also suitable in which the position of the musical note iconic image in the direction of the pitch axis is changed according to an instruction to move the operation iconic image in the direction of the pitch axis.

For example, the display controller disposes the operation iconic image in a predetermined position with respect to the musical note iconic image, and when an other musical note iconic image is disposed in the predetermined position, the display controller disposes the operation iconic image in a position different from the predetermined position and not overlapping the other musical note iconic image. According to this structure, since the musical note iconic image and the operation iconic image are prevented from overlapping each other, there is an advantage that the user can easily check the musical note iconic images.

Even with a structure in which the user arbitrarily designates a section to be edited (edit object section) of a song on the time axis displayed on the display device, as in the above-described case where an instruction to edit musical notes is provided, there are cases where it is difficult to provide an instruction to change a display length or a display position of the edit object section. For example, when a touch panel is used as the input device for designating the edit object section, if the user who intends to change the display length or the display position of the edit object section puts his/her finger close to the display screen, the target edit object section is hidden behind the finger, so that it is difficult to instruct a desired change amount while accurately grasping the edit object section. In view of the above circumstances, a music information display control apparatus according to another embodiment of the present disclosure includes a display controller for displaying, on the display device, a song image including: a song area where a time axis is set; an edit object section according to an instruction from the user in the song area; and a section operation iconic image that accepts the instruction from the user, and the display controller changes the display length or the display position of the edit object section in the direction of the time axis according to an instruction to move the section operation iconic image in the direction of the time axis. With the above structure, since the display length or display position of the edit object section is changed by a manipulation on the section operation iconic image disposed separately from the edit object section, an advantage is obtained that the change of the edit object section is easy compared with the structure in which the display length or the display position is changed by a direct operation on the edit object section. In detailed, according to an instruction from the user on an edit object section, the display controller displays, on the display device, a musical note sequence image in which the musical note iconic images of the musical notes in the edit object sections of a song are arranged in the musical score area.

The music information display control apparatus according to the present disclosure is implemented by a cooperation between a general-purpose arithmetic processing unit such as a CPU (central processing unit) and a program as well as implemented by hardware (electronic circuit) such as a DSP (digital signal processor) exclusively used for music information display. The program of the present disclosure is a program that causes a computer to execute display control processing of displaying, on the display device, a musical note sequence image where the musical note iconic image for each musical note is disposed in a musical score area where the pitch axis and the time axis are set, and in the display control processing, the operation iconic image that accepts an instruction from the user is disposed in the vicinity of the musical note iconic image, and the display length of the musical note iconic image in the direction of the time axis is changed according to an instruction to move the operation iconic image in the direction of the time axis. According to this program, similar workings and effects to those of the sound synthesizing apparatus of the present disclosure are realized. The program of the present disclosure is installed on a computer by being provided in the form of distribution through a communication network as well as installed on a computer by being provided in the form of being stored in a computer readable recording medium.

Although the invention has been illustrated and described or the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2012-179860 filed on Aug. 14, 2012 and Japanese Patent Application No. 2013-120277 filed on Jun. 6, 2013, the content of which are incorporated herein by reference.

What is claimed is:

1. A music information display control method comprising:

displaying, on a display device, a musical note sequence image in which a plurality of musical note iconic images corresponding to musical notes are disposed in a musical score area where a time axis is set;

disposing an operation iconic image in a vicinity of one of the musical note iconic images;

accepting an instruction from a user on the operation iconic image; and changing a display length or a display position of the musical note iconic image in a direction of the time axis according to the instruction to move the operation iconic image wherein the operation iconic image is disposed in the vicinity of only the musical note iconic image selected among from the musical note iconic images by the user, and the operation iconic image is not disposed in a vicinity of the musical note iconic image being not selected among from the musical note iconic images by the user.

2. The music information display control method according to claim 1, wherein the operation iconic image is disposed in a vicinity of an end portion of the musical note iconic image in the time axis; and wherein a display position of the end portion of the musical note iconic image is changed according to the instruction to move the operation iconic image in a direction of the time axis.

3. The music information display control method according to claim 1, further comprising:

switching between display and non-display of the operation iconic image.

4. The music information display control method according to claim 3, wherein the display and the non-display of the operation iconic image is switched in accordance with a display magnification of the musical score area.

5. The music information display control method according to claim 1, wherein in the disposing step, when a plurality of musical note iconic images in the musical score area are designated, one operation iconic image for the musical note iconic images is disposed; and wherein in the changing step, the display length, in the direction of the time axis, of at least one of the musical note iconic images is changed in accordance with the instruction to move the one operation iconic image.

6. The music information display control method according to claim 1, wherein for each musical note, basic information designates a pitch and an utterance period of the musical note and attribute information designates a musical expression of the musical note, the music information display control method further comprising:

changing the attribute information of the musical note corresponding to the musical note iconic image according to an instruction from the user on the operation iconic image in the vicinity of the musical note iconic image.

7. The music information display control method according to claim 1, wherein a pitch axis is set in the musical score area; and wherein a display position of the musical note iconic image in a direction of the pitch axis is changed while maintaining the display length or the display position of the musical note iconic image in the direction of the time axis according to the instruction to move the operation iconic image.

8. The music information display control method according to claim 1, wherein a pitch axis is set in the musical score area; and wherein a display position of the musical note iconic image in a direction of the pitch axis is changed according to the instruction to move the operation iconic image in the direction of the pitch axis.

9. The music information display control method according to claim 1, wherein in the disposing step, the operation iconic image is disposed in a predetermined display position with respect to the musical note iconic image, and when an other musical note iconic image is disposed in the predetermined display position, the operation iconic image is disposed in a display position different from the predetermined display position and not overlapping the other musical note iconic image.

10. The music information display control method according to claim 1, further comprising:

displaying, on the display device, a song image including a song area where a time axis is set, an edit object section according to an instruction from the user in the song area, and a section operation iconic image that accepts the instruction from the user;

changing a display length or a display position of the edit object section in the direction of the time axis according to an instruction to move the section operation iconic image in the direction of the time axis; and displaying, on the display device, the musical note sequence image corresponding to the edit object section according to the instruction from the user.

11. A music information display control apparatus comprising:

one or more processors configured to display, on a display device, a musical note sequence image in which a plurality of musical note iconic images corresponding to musical notes are disposed in a musical score area where a time axis is set, wherein the one or more processors dispose an operation iconic image which accepts an instruction from a user in a vicinity of one of the musical note iconic images, and changes a display length or a display position of the musical note iconic image in a direction of the time axis according to the instruction to move the operation iconic image, wherein the one or more processors dispose the operation iconic image in the vicinity of only the musical note iconic image selected among from the musical note iconic images by the user, and do not dispose the operation iconic image in a vicinity of the musical note iconic image being not selected among from the musical note iconic images by the user.

12. The music information display control apparatus according to claim 11, wherein the one or more processors dispose the operation iconic image in a vicinity of an end portion of the musical note iconic image in the time axis; and wherein the one or more processors change a display position of the end portion of the musical note iconic image according to the instruction to move the operation iconic image in a direction of the time axis.

13. The music information display control apparatus according to claim 11, wherein the one or more processors switch between display and non-display of the operation iconic image.

14. The music information display control apparatus according to claim 13, wherein the one or more processors switch the display and the non-display of the operation iconic image in accordance with a display magnification of the musical score area.

15. The music information display control apparatus according to claim 11, wherein when a plurality of musical note iconic images in the musical score area are designated, the one or more processors dispose one operation iconic image for the musical note iconic images, and changes the display length, in the direction of the time axis, of at least one of the musical note iconic images according to the instruction to move the one operation iconic image.

16. The music information display control apparatus according to claim 11, further comprising:

an information manager configured to manage, for each musical note, basic information designating a pitch and an utterance period of the musical note and attribute information designating a musical expression of the musical note, wherein the information manager changes the attribute information of the musical note corresponding to the musical note iconic image according to an instruction from the user on the operation iconic image in the vicinity of the musical note iconic image.

17. The music information display control apparatus according to claim 11, wherein a pitch axis is set in the musical score area; and wherein the one or more processors change a display position of the musical note iconic image in a direction of the pitch axis while maintaining the display length or the display position of the musical note iconic image in the direction of the time axis according to the instruction to move the operation iconic image.

18. The music information display control apparatus according to claim 11, wherein a pitch axis is set in the musical score area; and wherein the one or more processors change a display position of the musical note iconic image in a direction of the pitch axis according to the instruction to move the operation iconic image in the direction of the pitch axis.

19. The music information display control apparatus according to claim 11, wherein the one or more processors dispose the operation iconic image in a predetermined display position with respect to the musical note iconic image; and wherein when an other musical note iconic image is disposed in the predetermined display position, the one or more processors dispose the operation iconic image in a display position different from the predetermined display position and not overlapping the other musical note iconic image.

20. The music information display control apparatus according to claim 11, wherein the one or more processors display, on the display device, a song image including a song area where a time axis is set, an edit object section according to an instruction from the user in the song area, and a section operation iconic image that accepts the instruction from the user;

wherein the one or more processors change a display length or a display position of the edit object section in the direction of the time axis according to an instruction to move the section operation iconic image in the direction of the time axis; and wherein the one or more processors display, on the display device, the musical note sequence image corresponding to the edit object section according to the instruction from the user.

21. The music information display control method according to claim 1, wherein in the disposing step, when the plurality of musical note iconic images in the musical score area are designated, one operation iconic image for the musical note iconic images is disposed; and wherein in the changing step, the display length, in the direction of the time axis, of all of the designated musical note iconic images are changed in accordance with the instruction to move the one operation iconic image.

22. The music information display control apparatus according to claim 11, wherein when a plurality of musical note iconic images in the musical score area are designated, the one or more processors dispose one operation iconic image for the musical note iconic images, and changes the display length, in the direction of the time axis, of all of the designated musical note iconic images according to the instruction to move the one operation iconic image.

* * * * *